US009848754B2

(12) United States Patent
Baldwin et al.

(10) Patent No.: US 9,848,754 B2
(45) **Date of Patent: *Dec. 26, 2017**

(54) DISH RACK WITH DISPENSER UNIT

(71) Applicant: Whirlpool Corporation, Benton Harbor, MI (US)

(72) Inventors: Mark W. Baldwin, Saint Joseph, MI (US); Paul E. Beshears, Jr., Stevensville, MI (US); Scott D. Slabbekoorn, Saint Joseph, MI (US); Elliott V. Stowe, Stevensville, MI (US); Barry E. Tuller, Stevensville, MI (US); Ameresh B. Viswanathan, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1134 days.

This patent is subject to a terminal disclaimer.

(21) Appl. No.: 14/031,065

(22) Filed: Sep. 19, 2013

(65) Prior Publication Data

US 2014/0137911 A1 May 22, 2014

Related U.S. Application Data

(60) Provisional application No. 61/727,812, filed on Nov. 19, 2012.

(51) Int. Cl.
*A47L 15/50* (2006.01)
*A47L 15/44* (2006.01)

(52) U.S. Cl.
CPC ..... *A47L 15/508* (2013.01); *A47L 15/44* (2013.01)

(58) Field of Classification Search
CPC ..... A47L 15/508; A47L 15/44; A47L 15/50; A47L 15/505
(Continued)

(56) References Cited

U.S. PATENT DOCUMENTS 3,133,673 A * 5/1964 Buss ..... A47L 15/44 222/129
7,832,417 B2 * 11/2010 Gunnerson ..... A47L 15/44 134/56 D
(Continued)

FOREIGN PATENT DOCUMENTS

BE 1882439 A1 * 1/2008 ..... A47L 15/4257
CA 2572782 A1 2/2006
(Continued)

OTHER PUBLICATIONS

Machine translation of DE 60102828 T2, dated Apr. 2005.*
German Search Report for Corresponding DE102013111240.4, dated March 20, 2014.

*Primary Examiner* — Michael Wieczorek
*Assistant Examiner* — Kevin G Lee

(57) ABSTRACT

A dish rack for use in a dishwasher is provided. The dishwasher includes a tub defining a washing chamber for cleaning kitchenware and the like. The dish rack includes a wall bounding a space. A dispenser unit is mounted to the dish rack and is configured to hold an additive. A hydraulic circuit is disposed within the walls of the dish rack and is placed in fluid communication with the dispenser. Fluid pressure from the hydraulic circuit is operable to eject the additive from the dispenser unit into the washing chamber.

22 Claims, 14 Drawing Sheets

(58) Field of Classification Search
USPC ..... 134/56 D, 57 D, 58 D, 93
See application file for complete search history.

(56) References Cited

U.S. PATENT DOCUMENTS

| | | | | |
|---|---|---|---|---|
| 7,985,298 | B2 * | 7/2011 | Purtilo | A47L 15/14 134/25.2 |
| 2002/0185166 | A1 * | 12/2002 | Rosenbauer | A47L 15/502 134/200 |
| 2006/0144424 | A1 * | 7/2006 | Marchitto | A47L 15/4409 134/25.2 |
| 2007/0272272 | A1 | 11/2007 | Choi et al. | |
| 2008/0053494 | A1 | 3/2008 | Moro et al. | |
| 2012/0285491 | A1 * | 11/2012 | Blanchard | A47L 15/16 134/25.2 |

FOREIGN PATENT DOCUMENTS

| | | | | |
|---|---|---|---|---|
| CN | 1988840 | A | 6/2007 | |
| CN | 200991214 | Y | 12/2007 | |
| CN | 102327107 | A | 1/2012 | |
| CN | 202143618 | U | 2/2012 | |
| DE | 3807715 | A1 | 9/1989 | |
| DE | 69527058 | T2 | 10/2002 | |
| DE | 60102828 | T2 | 4/2005 | |
| EP | 0517015 | A1 | 12/1992 | |
| EP | 0755650 | A1 | 1/1997 | |
| EP | 1281346 | A1 | 2/2003 | |
| EP | 1281347 | A1 | 2/2003 | |
| EP | 1319360 | A1 | 6/2003 | |
| EP | 1366704 | A2 | 12/2003 | |
| EP | 1723894 | A1 | 11/2006 | |
| EP | 1610663 | B1 | 4/2010 | |
| EP | 2387936 | A1 | 11/2011 | |
| FR | 2885788 | A1 | 11/2006 | |
| GB | 1027001 | A | 4/1966 | |
| GB | 1289412 | | 9/1972 | |
| JP | 2001286428 | A | 10/2001 | |
| JP | 2002325714 | A | 11/2002 | |
| JP | 2003093318 | A | 4/2003 | |
| JP | 2007236800 | A | 9/2007 | |
| JP | 2011527918 | A | 11/2011 | |
| NL | 0755650 | A1 * | 1/1997 | A47L 15/4409 |
| WO | 2004084699 | A2 | 10/2004 | |
| WO | 2006069827 | A1 | 7/2006 | |
| WO | 2011141145 | A1 | 11/2011 | |
| WO | 2011157328 | A1 | 12/2011 | |

* cited by examiner

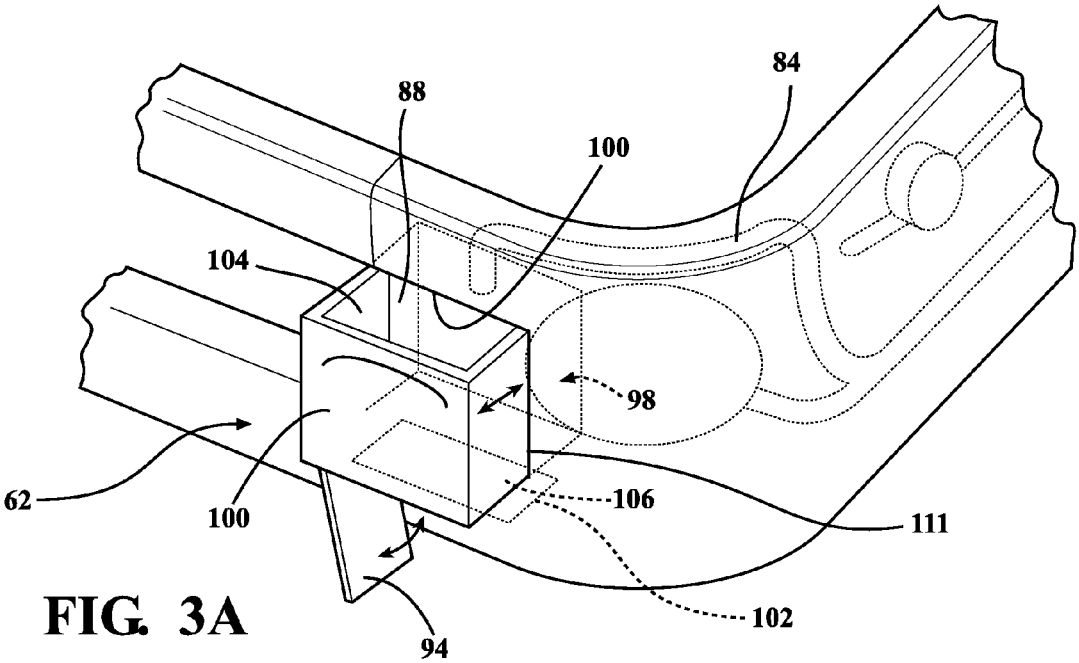
FIG. 3A
FIG. 4
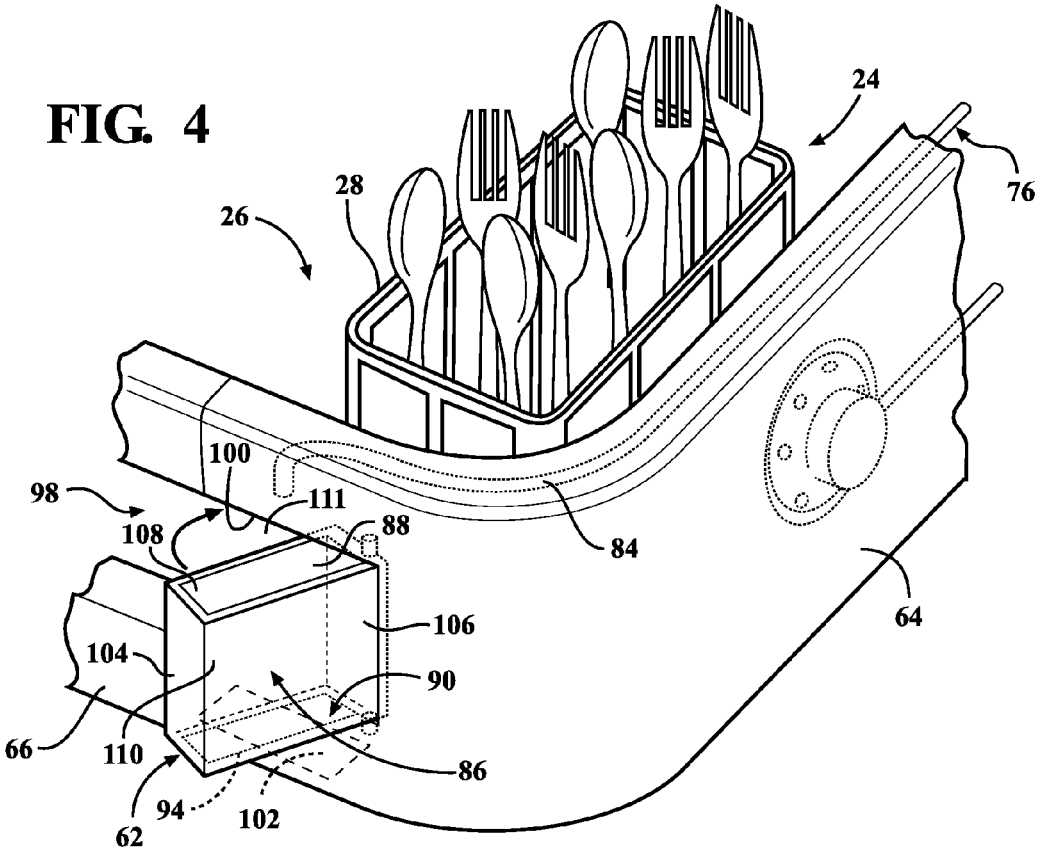

DISH RACK WITH DISPENSER UNIT

CROSS-REFERENCE TO RELATED APPLICATIONS

The present application claims the benefit of U.S. Provisional Patent Application No. 61/727,812, filed Nov. 19, 2012, which is incorporated by reference herein in its entirety.

BACKGROUND OF THE INVENTION

Field of the Invention

The present invention pertains to the art of dish racks for use in dishwashers and, more particularly, to a dish rack having a dispenser unit.

Description of the Related Art

A front loading dishwasher typically includes a tub having an open front. The tub defines a washing chamber into which items, such as kitchenware, glassware and the like, are placed to undergo a washing operation. The dishwasher is generally provided with a door, pivotally mounted to the tub, that closes the open front.

The dishwasher includes upper and lower extensible dish racks for supporting items during washing operations. Typically, the upper and lower dish racks are formed primarily of a durable, rigid and water resistant material such as chemically treated steel. The dish racks may include supports for holding a basket configured to retain items such as spoons, forks, and knives.

A spraying system is operable to spray liquid into the tub. The spraying system may include an upper sprayer, a lower sprayer, and a spray manifold. The spray manifold is configured to receive water from a pump and filter assembly within the tub. The spray manifold includes a hydraulic conduit fluidly connected to the upper and lower sprayer. The upper sprayer may be located below the upper rack, and includes spray apertures configured to introduce liquid upwardly and downwardly within the tub. The lower sprayer may be located on the bottom floor of the tub, and includes spray apertures configured to introduce liquid upwardly within the tub. A top sprayer may be located above the upper rack and configured to spray water downward. The upper and lower sprayer may be a rotatable spray arm or may be fixed.

Current dishwashers include dispenser units for adding additives, such as a detergent, to the washing chamber during washing operations. The dispenser units are typically mounted to the door, and project outwardly from an inner surface of the door into the washing chamber. The dispenser unit is enclosed by a cover, which may be automatically opened during washing operations. The dispenser unit may be further configured to introduce the additive into the washing chamber by gravity. In some instances, a spray nozzle may be configured to eject water into the open dispenser unit so as to help ensure that all the detergent is introduced into the washing chamber. Accordingly, current dispenser units mounted to the inner surface of the door limit the volume of the washing chamber as well as the length of the dish racks.

In some instances, the door may include two dispenser units. One dispenser unit may be configured to hold a single load of washing detergent. The other dispenser unit may be configured to hold a different type of additive. The washing additive may be designed to achieve a specific washing function, for instance, the washing additive may be configured to prevent stains from developing on items such as glass or silverware. Such washing additives are currently known and illustratively include an additive configured to assist with rinsing items. The other dispenser unit may be configured to hold multiple doses of the washing additive, and may include an actuator operable to dispense a single dose of the washing additive during a single washing load. The use of such an actuator enlarges the size of the dispenser unit and thus further decreases the volume of the washing chamber.

In both instances, the dispenser units are configured to introduce a single dose of an additive into the washing chamber. Water from a plumbed water source is introduced into the washing chamber, and the respective detergent or washing additive is mixed with the wash water and further distributed throughout the washing chamber via the spraying system during washing operations. In such a configuration, a washing additive configured to clean silverware may be applied to kitchenware made of material other than silver. Accordingly, neither the detergent nor the washing additive may be concentrated on a specific spray zone.

Based on the above, there still exists a need in the art for a dishwasher wherein the dispenser unit does not project outwardly from the inner surface of the door and into the washing chamber. Further, it remains desirable to have a dishwasher wherein washing additives may be introduced into a specific wash zone of the washing chamber.

SUMMARY OF THE INVENTION AND ADVANTAGES

The present invention is generally directed to a dish rack for use in a dishwasher. The dish rack includes a hydraulic circuit and a dispenser unit configured to hold a washing additive, such as detergent or a rinsing agent. The hydraulic circuit is configured to supply water to the dispenser unit, and eject the washing additive from the dispenser unit into the washing chamber.

The dispenser unit may also be configured to spray the washing additive into a specific wash zone. In such an application, the dispenser unit is also in fluid communication a spray nozzle. The spray nozzle is in fluid communication with the hydraulic circuit. The spray nozzle may be disposed on an inner surface wall of the dish rack and positioned downstream from the dispenser unit. A passage of the hydraulic circuit may extend between both the dispenser unit and the spray nozzle. Thus, water may fill the dispenser unit, mix with the additive, and the additive and water are sprayed through the spray nozzle into a desire wash zone.

The dish rack may further include a dispenser unit configured to hold a bulk amount of washing additive and eject a single dose of the additive into the washing chamber during washing operations. The dispenser unit includes a dispensing mechanism operable to distribute a discrete amount of additive into the washing chamber. The dispensing mechanism may be actuated by fluid pressure from the hydraulic circuit. Accordingly, the dispenser unit may hold a bulk supply of a washing additive, and introduce a single dose of the washing additive during a washing program.

Accordingly, the dish rack increases the volume of the work space relative to current dishwashers, as the need for a dispenser unit projecting from the inner surface of the door is eliminated. Further, the dishwasher is able to spray additives into a specific wash zone, thus improving the performance of the dishwasher relative to current dishwashers.

BRIEF DESCRIPTION OF THE DRAWINGS

Advantages of the present invention will be readily appreciated as the same becomes better understood by reference to the following detailed description when considered in connection with the accompanying drawings wherein:

FIG. 3*a* is an isolated view of the dispenser unit shown in FIG. 3;

FIG. 4 is a perspective view of a dish rack showing another embodiment of a dispenser unit pivotably mounted to the dish rack;

DETAILED DESCRIPTION OF PREFERRED EMBODIMENTS

Figure 1:
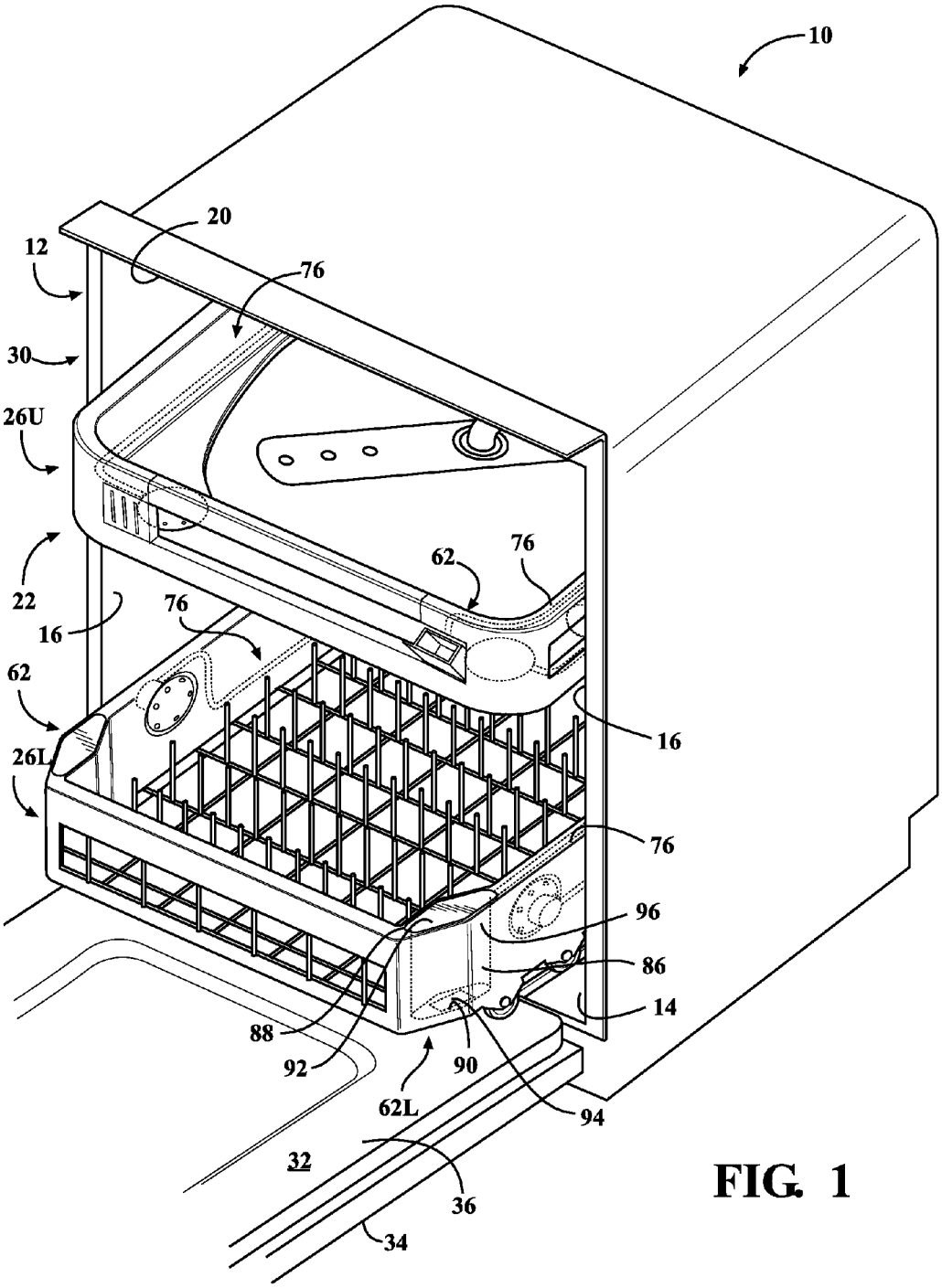
FIG. 1 is a perspective view of a dishwasher incorporating a dish rack having a dispenser unit.
Figure 11:
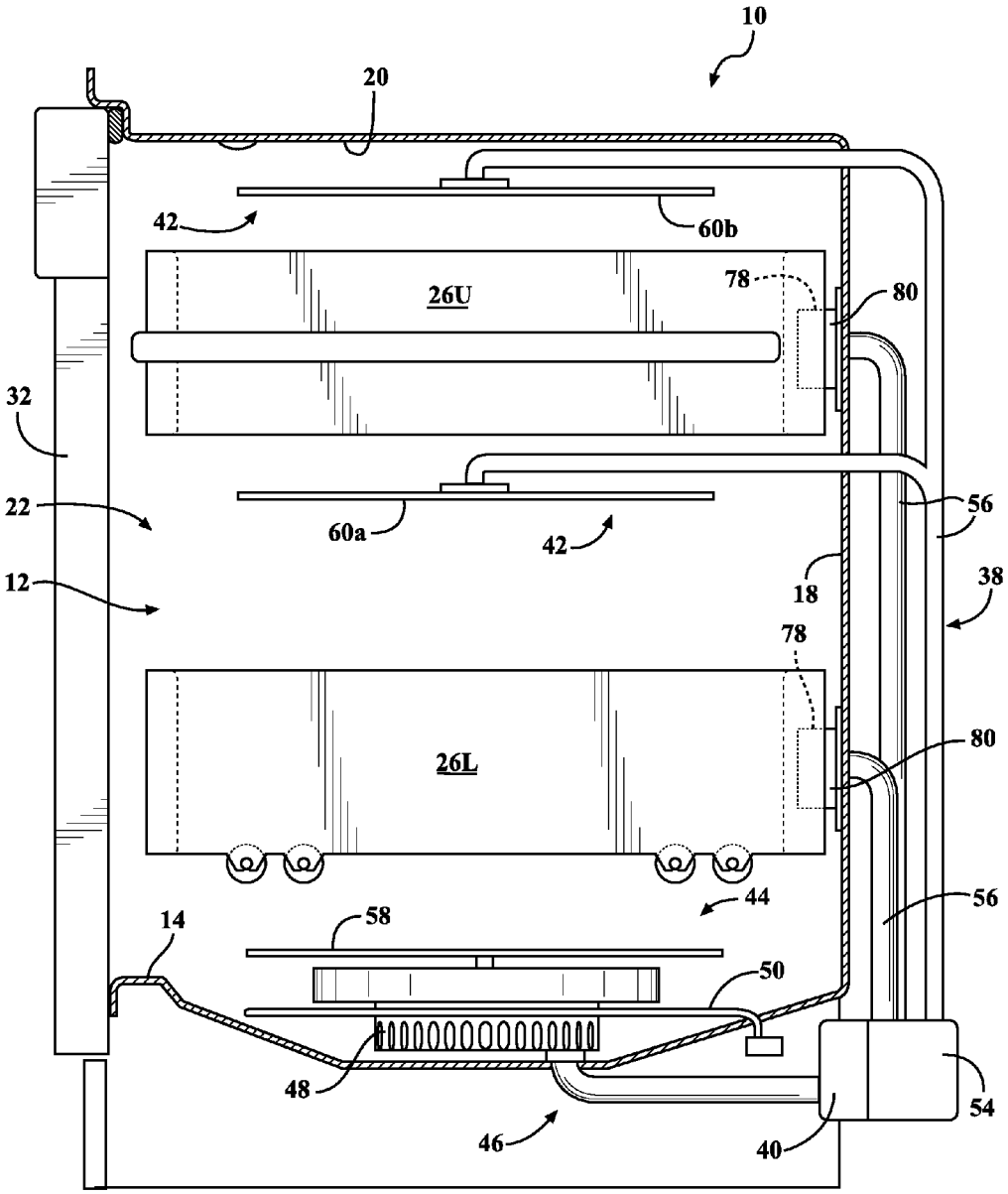
FIG. 11 is a schematic view of FIG. 1, showing the dish racks in the first position.

With initial reference to FIGS. 1 and 11, a dishwasher 10 is provided. As shown, dishwasher 10 includes a tub 12. The tub 12 includes an integral inner bottom wall 14, a pair of spaced apart and opposite inner side walls 16, an inner back wall 18, and an inner top wall 20. Preferably, the tub 12 is formed of injection molded plastic. Within the confines of the inner bottom, inner sides, inner back and inner top walls 14, 16, 18, 20, the tub 12 defines a washing chamber 22, within which soiled kitchenware or utensils (not shown) may be placed on a respective lower dish rack 26L and/or upper dish rack 26U. The lower and upper dish racks are generally referenced as 26 in the figures and may also be referenced specifically as 26U or 26L throughout this description.

As shown in FIG. 4, a utensil basket 28, which contains a utensil 24, is positioned within the lower dish rack 26L, alternatively a utensil basket could be placed in the upper rack 26U. Tub 12 has associated therewith a frontal portion 30 at which is pivotally supported a door 32. The door 32 is used to seal washing chamber 22 during a washing operation. The door 32 has an exterior panel 34 and an interior panel 36.

The dishwasher 10 includes a spraying system 38. The spraying system 38 is configured to spray liquid into the tub 12. The spraying system 38 may include a spray manifold 40, an upper sprayer 42, a lower sprayer 44 and an intake 46. The upper and lower sprayer 42, 44 may be a rotatable spray arm or may be fixed. Additionally, the spraying system 38 may include a top sprayer mounted 60*b* so as to deliver wash water downwardly into the tub 12.

Disposed within tub 12, is a pump and filter assembly 48. The pump and filter assembly 48 may be mounted within a central opening (not shown) formed in the inner bottom wall 14 of tub 12. Extending about a substantial portion of pump and filter assembly 48, at a position raised above inner bottom wall 14, is a heating element 50. In a manner known in the art, heating element 50 preferably takes the form of a sheathed, electric resistance-type heating element 50. In general, water from a plumbed water source such as a water heater, or a utility source is delivered into the washing chamber 22 through a main intake (not shown). The pump and filter assembly 48 is adapted to direct washing fluid introduced into the tub 12 through the main outtake 46 to the spray manifold 40 and out the upper and lower sprayers 42, 44.

Dishwasher 10 has associated therewith a drain hose (not shown) including at least one corrugated or otherwise curved portion that extends about an arcuate hanger (not shown) provided on an outside surface of dishwasher 10. The drain hose is also preferably secured to tub 12 through various clips in a manner known to those skilled in the art.

The dishwasher 10 may further include a diverter 54, seen at least in FIG. 11. The diverter 54 is operatively connected to the spray manifold 40. The spray manifold 40 may include a plurality of hydraulic conduits 56, each placing the wash water collected in the sump to a respective lower spray arm 58 of the lower sprayer 44, and upper spray arms 60*a*, 60*b* of the upper sprayer 42. The diverter 54 may be actuated to selectively open and close the hydraulic conduit 56 so as to place a respective lower spray arm 58 and/or upper spray arms 60*a*, 60*b* in fluid communication with the pump and filter assembly 48 in correspondence with the selected wash cycle. Thus, in certain periods of a selected wash cycle, the diverter 54 may be actuated so as to direct wash water to the lower spray arm 58, closing off fluid communication to the upper spray arm 60, or vice-versa.

It should be appreciated that the diverter 54 may be configured to provide fluid to both the upper and lower spray arms 60, 58. The diverter 54 may further be configured to provide fluid to the upper and lower dish racks 26U, 26L. The hydraulic conduit 56 may include passages 84 dedicated to supply water to the upper and lower dish racks 26U, 26L, and the upper and lower spray arms 58, 60*a*, 60*b*. For instance, the diverter 54 may include valves (not shown) opening and closing passages of the hydraulic conduit 56 which provide water to the respective upper and lower dish racks 26U, 26L, and the upper and lower spray arms 58, 60*a*, 60*b*. The valve may be mechanically actuated so as to control the opening of a specific passage to support a wash function.

With reference now to FIGS. 1 and 11, a dish rack 26 having a dispenser unit 62 for use in a dishwasher 10 is provided. The dish rack 26 may be configured to introduce an additive, such as detergent, into the dishwasher 10 during washing operations. The dish rack 26 may also be configured to introduce an additive, such as a silverware polisher, into a specific wash zone of the dishwasher 10. The dish rack 26 may be further configured to hold a bulk amount of an additive, such as a rinsing agent, and deliver a single dose of the rinsing agent during washing operations.

With reference now to FIGS. 2-10 an illustrative embodiment of a dish rack, generally referenced as 26 and specifically as 26U or 26L, as the case may be, is provided. The dish rack 26 includes a wall bounding a space for containing items to be washed. The wall may include a pair of side walls generally referenced as 64, and specifically as 64*a* or 64*b* as the case may be, a front wall 66, a back wall 68, and a base 70. The side, front and back walls 64, 66, 68 of the dish rack 26 may be formed of an injection molded polymer currently known and used in the art, illustratively including polymers having a high gloss, satin, matte, or metallic finish. The polymer may also be configured to have a color, show a pattern, or have a translucent look. The base 70 may be formed of interconnected wires 72 so as to define a support for kitchen utensils and the like. Some of the wires 72 may extend upwardly to support utensils in a generally upright manner, additionally the wires 72 provide structural strength to the dish rack 26. It should be appreciated that the base 70 may be configured otherwise. For instance, the base 70 may be formed of a continuous planar member extending between respective side wall 64 and the front and back walls 66, 68 so as to form what is commonly referenced in the art as a drawer type dish rack 26. In such as embodiment, the base 70 typically includes an outlet for allowing water to drain.

Figure 8:
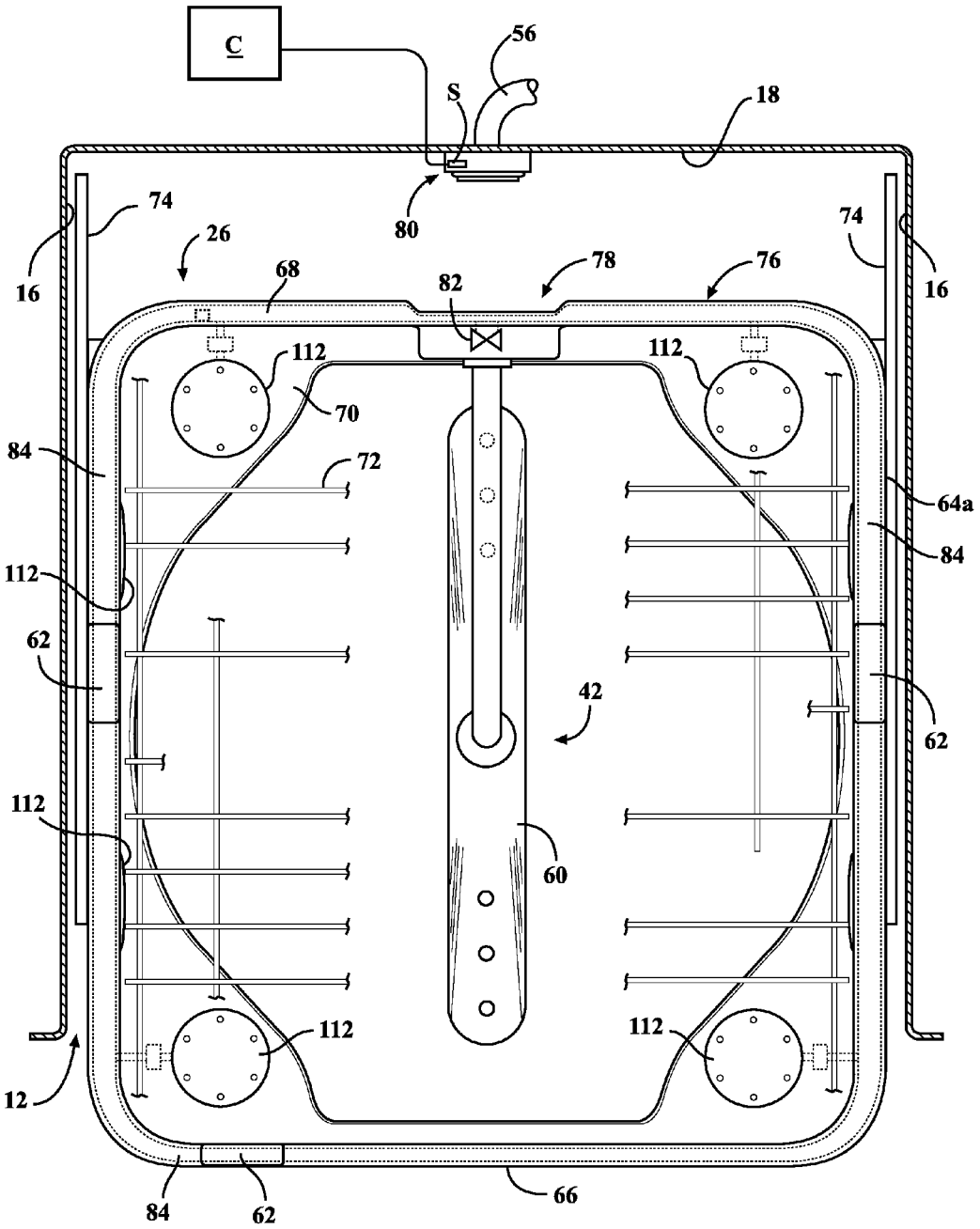
FIG. 8 is a top view of a dish rack disengaged from a tub outtake.
Figure 9:
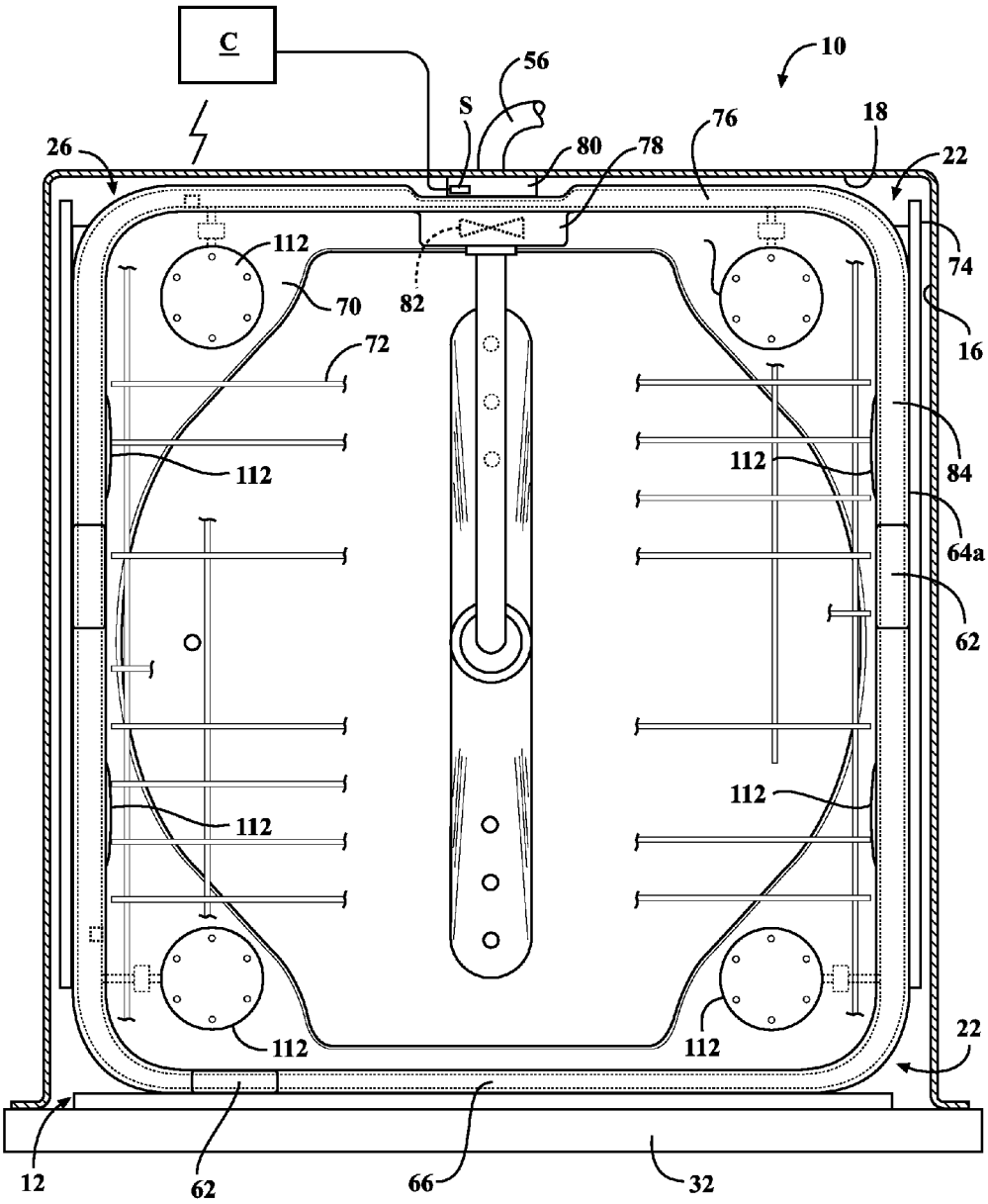
FIG. 9 is a top view of the dish rack engaged with a tub outtake.

The outer surface of each of the side walls 64 may be adapted to slidingly engage the inner side walls 16 of the tub 12 between a first position and a second position. For instance, the outer surface of the side walls 64 may include a plurality of rollers configured to engage a respective side rail 74 of the tub 12 (as seen in FIGS. 8 and 9). The side rail 74 extends axially along a horizontal plane of the inner side wall 16 of the tub 12. In the first position, the dish rack 26 is fully disposed within the washing chamber 22 of the tub 12 and placed in fluid communication with the spraying system 38, as shown in FIG. 9. In the second position, the dish rack 26 is displaced outwardly from the washing chamber 22 to assist the user with loading the dish rack 26 with utensils, as shown in the lower dish rack 26 of FIG. 1. It should be appreciated that the dish rack may be slidably mounted in other manners currently known and used in the art. For instance, the lower dish rack 26L may include wheels adapted to roll along a track disposed on the inner bottom wall 14 of the tub 12.

The dish rack 26 includes a hydraulic circuit 76 disposed between the outer and inner surfaces of the dish rack 26. The dish rack 26 further includes a hydraulic circuit intake 78 disposed on an end portion of the hydraulic circuit 76, as shown in FIGS. 2-10. The hydraulic circuit intake 78 is configured to fluidly engage the hydraulic conduit 56 of the spraying system 38, as shown in FIGS. 8 and 9. Preferably, the hydraulic circuit intake 78 is disposed on an outer surface of the back wall 68 of the dish rack 26. The hydraulic circuit intake 78 is configured to seal with a tub outtake 80 of the spraying system 38 so as to create a sealed connection when the dish rack 26 is placed in the first position. The hydraulic circuit intake 78 is disengaged from the spraying system 38 when the dish rack 26 is placed in the second position.

The dish rack 26 may further include a main valve 82, shown in FIGS. 2, 3, 5, 6, 8 and 9. The main valve 82 is operable to open and close fluid communication to the dispenser units 62. The main valve 82 is operatively connected to the hydraulic conduit 56 and may be disposed upstream from the dispenser units 62 and downstream from the hydraulic circuit intake 78 so as to be disposed within the dish rack 26. Any valve currently known and used in the art may be adapted for use herein, illustratively including a mechanical timer which is pressure or flow operated so as to close or open an opening based upon fluid pressure or flow.

The dish rack 26 is configured to introduce an additive such as detergent or a rinsing agent into the tub 12. The dish rack 26 may be further configured to introduce an additive into a specific wash zone. The dispenser unit 62 is in fluid communication with the hydraulic circuit 76. The hydraulic circuit 76 is configured to be placed in fluid communication with the hydraulic conduit 56 of spraying system 38. The pump and filter assembly 48 is configured to distribute pressurized water throughout the hydraulic conduit 56 of spraying system 38 and the hydraulic circuit of the dish rack 26. The pressurized water is introduced into the dispenser so as to eject the additive into the washing chamber 22.

Figure 2:
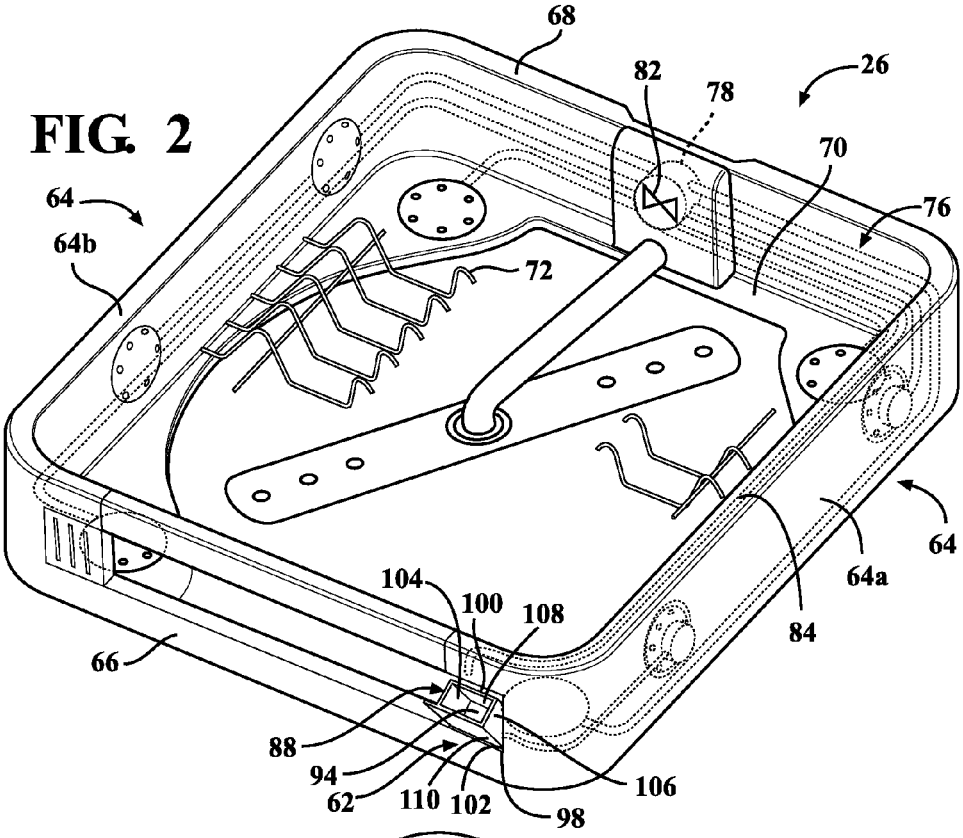
FIG. 2 is a perspective view of a dish rack showing an embodiment of a dispenser unit pivotably mounted to the dish rack.
Figure 3:
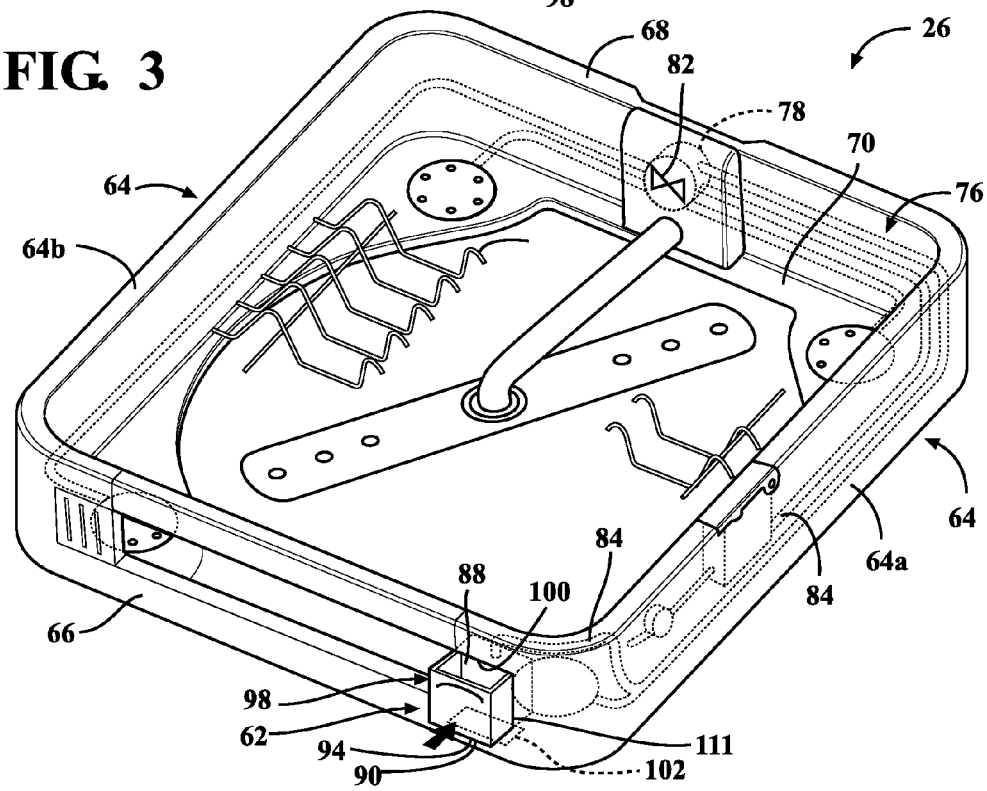
FIG. 3 is a perspective view of a dish rack showing an embodiment of a dispenser unit slidably mounted to the dish rack.

As shown in FIGS. 1, 2, and 3, the dispenser unit 62 may be housed within the front wall 66 of the dish rack 26. As described above, the dispenser unit 62 may be modified to achieve a specific function. Accordingly, it should be appreciated by those skilled in the art that the dispenser unit 62 may be located on the dish rack 26 in locations other than what is shown in the Figures. For instance, the dispenser unit 62 may be housed within the back wall 68 of the dish rack 26.

With reference again to FIG. 1, a dispenser unit 62L configured to dispense a single dose of detergent is provided. The dispenser unit 62L is disposed within the side wall 64 of the lower dish rack 26L. The dispenser unit 62L is mounted within the front corner of the lower dish rack 26L. The dispenser unit 62L includes a storage chamber 86 having a top opening 88 and an outlet 90. A cover 92 may be operatively attached to the top opening 88 and is opposite from a dispenser unit door 94 which is operatively attached to the outlet 90.

The storage chamber 86 includes a chamber wall 96 bounding a space configured to hold detergent. The storage chamber 86 may be formed as one with the dish rack 26 during the injection molding process. Attachment features for mounting the cover 92 and the dispensing unit door 92 to the dispenser unit 62L may also be formed as one with the dish rack 26 during the injection molding process. A passage 84 of the hydraulic circuit 76 is placed in fluid communication with the storage chamber 86.

The cover 92 is operatively attached to a top opening 88 of the storage chamber 86 so as to provide access for introducing detergent into the storage chamber 86, and to close the storage chamber 86. The dispenser unit 62L may include a latch assembly (not shown) operable to keep the cover 92 closed relative to the top opening 88. The latch assembly is configured to retain the cover 92 in a closed position. The latch assembly may be configured to release the cover 92 upon a push from the user, or may include a button (not shown) operable to release the cover 92 from the open position.

Figure 10:
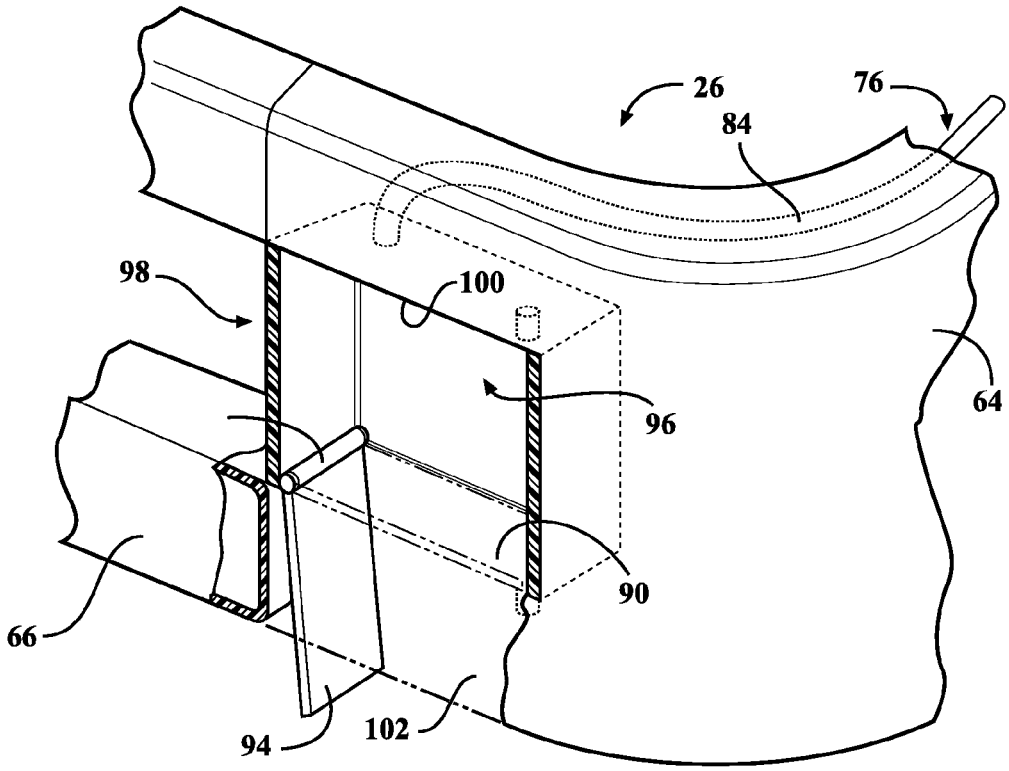
FIG. 10 is a perspective view of an embodiment of a dispenser unit showing the storage chamber and operation of the dispenser unit door.

The outlet 90 is configured to allow the additive to escape into the washing chamber 22. The dispenser unit door 94 is operatively mounted to the outlet 90. A closing mechanism (not shown) may be mounted to the dispenser unit door 94. The closing mechanism is configured to move the dispenser unit door 94 between an open position and a closed position, the concept is generally shown in FIG. 10. In the open position, the dispenser door 94 is displaced from the outlet 90 so as to allow the contents of the storage chamber 86 to fall into the washing chamber 22. In the closed position the dispenser unit door 94 is engaged with the outlet 90 so as to retain the additive within the storage chamber 86.

In one embodiment of a closing mechanism, the closing mechanism is operable to urge the dispenser unit door 94 into a closed position. For instance, a spring, commonly referenced by those skilled in the art as a torsion spring, may be used as a biasing member to urge the dispenser unit door 94 into the closed position. The torsion spring may be operatively mounted to a hinged section of the dispenser unit door 94. The torsion spring may be configured to allow the dispenser unit door 94 to open under a predetermined pressure from the introduction of water into the storage chamber 86. Water from the hydraulic circuit 56 fills the spaces of the storage chamber 86. Pressure from water pumped into the filled storage chamber overcomes the biasing force of the biasing member so as to open the dispenser unit door 94. Thus, the hydraulic pressure may be used to distribute the contents of the storage chamber 86 into the washing chamber 22.

In operation, the user opens the cover 92 and introduces a dose of detergent into the storage chamber 86 and closes the cover 92. The dish rack 26 is placed in the first position wherein the hydraulic circuit 76 is operable to receive wash water from the spraying system 38. Wash water is introduced into the storage chamber 86, and creates fluid pressure within the storage chamber 86. The pressure is sufficient enough to overcome the retaining force of the closing mechanism, but insufficient to open the cover 92. Thus, the cover 92 remains closed, but the dispenser unit door 94 is opened. As wash water continues to flow through the storage chamber 86 of the dispenser unit 62, detergent is mixed therein and introduced into the tub 12. The mixture of wash water and detergent is distributed throughout the spraying system 38 via the pump and filter assembly 48. Upon completion of the wash cycle, fluid pressure is no longer exerted in the storage chamber 86 and thus, the closing mechanism is free to urge the dispenser unit door 94 in the closed position.

With reference again to FIGS. 2 and 4, another embodiment of a dispenser unit 62 configured to introduce detergent into the tub 12 is provided. The dispenser unit 62 is pivotably attached to a dispenser unit housing 98 formed on the front wall 66 of an upper dish rack 26. The dispenser unit housing 98 may be formed as one with the dish rack 26 during the injection molding process. The dispenser unit housing 98 includes a top housing wall 100 opposite from a bottom opening 102. The bottom opening 102 is disposed at the bottom of the front wall 66 of the dish rack 26. FIG. 2 shows the storage chamber 86 pivoted about an axis extending horizontally along the length of the front wall 66, whereas FIG. 4 shows the storage chamber 86 pivoted about a pin defining an axis extending along the height of the front wall 66. It should be appreciated that the dispenser unit 62 may be mounted in numerous ways, and the illustrations provided herein are not limiting the scope and practice of the invention herein.

The storage chamber 86 includes a top opening 88 and an outlet 90, as shown in FIG. 4. The outlet 90 may be disposed on the bottom of the storage chamber 86, opposite from the top opening 88. The storage chamber 86 is configured to hold the additive. As shown in FIG. 4, the storage chamber 86 may include a first wall 104 spaced apart from a second wall 106, a third wall 108 spaced apart from a fourth wall 110, each of the third and fourth wall 106, 108 extends between the first and second walls 104, 106 so as to define a generally rectangular shaped compartment. The dispenser unit door 94 may be disposed on the bottom of the storage chamber 86 and registered above the bottom opening 102 of the dispenser unit housing 98, the concept is generally show in FIG. 10. The closing mechanism is configured to urge the dispenser unit door 94 in a closed position relative to the bottom of the storage chamber 86. The storage chamber 86 includes a top opening 88 which may be closed when the dispenser unit door 94 is placed in the closed position.

The bottom opening 102 of the dispenser unit housing 98 is dimensioned so as to allow the dispenser unit door 94 to freely pivot to an open position. The dispenser unit 62 is in fluid communication with the hydraulic circuit 76. For instance, a passage 84 of the hydraulic circuit 76 may open into an inner surface of the front wall 66 of the dish rack 26, above the top opening 88 of the storage chamber 86. Accordingly, wash water may be introduced into the dispenser unit 62.

In operation, the user opens the dispenser unit 62 wherein the dispenser unit 62 is pivoted outwardly with respect to the outer surface of the front wall 66 of the dish rack 26. The top opening 88 is exposed, and the user may introduce a single dose of detergent into the storage chamber 86. It should be appreciated that the inner surface of the storage chamber 86 may include indicia for notifying the user of the amount of detergent used for various loads. For instance a plurality of raised lines may be used to indicate light, medium or heavy loads.

The user dispenses the appropriate amount of detergent and closes the dispenser unit 62, wherein the top opening 88 is placed below an opening of the passage 84 of the hydraulic circuit 76. The dish rack 26 is slid to the first position so as to be fluidly coupled with the spraying system 38, as shown in FIG. 9. The water from the spraying system 38 is introduced into the hydraulic circuit 76 and to the passage 84 in fluid communication with the dispenser unit 62. Pressure from the introduction of water urges the dispenser unit door 94 outwardly into the bottom opening 102 of the front wall 66 wherein detergent falls from the storage chamber 86 into the tub 12. The closing mechanism is thus free to urge the dispenser unit door 94 into the closed position when the wash water is no longer introduced into the dispenser unit 62.

With reference now to FIGS. 3 and 3*a*, yet another embodiment of a dispenser unit 62 configured to introduce detergent into the tub 12 is provided. In this embodiment, the dispenser unit 62 is slidably mounted to the front wall 66 of an upper dish rack 26. The front wall 66 includes a dispenser unit housing 98 configured to hold the dispenser unit 62. The dispenser unit housing 98 may be formed as one with the dish rack 26 during the injection molding process. The dispenser unit housing 98 includes a top housing wall 100 opposite from a bottom opening 102, a pair of side walls extend outwardly from an inner a back surface of the dish rack 26 so as to define a front housing opening 111 formed on the face of the front wall 66, and configured to receive the storage chamber 86.

The storage chamber 86 includes a top opening 88 and an outlet 90. The storage chamber 86 is configured to slide in and out of the dispenser unit housing 98 between a closed and open position. The top opening 88 of the storage chamber 86 is disposed under the top housing wall 100 of the dispenser unit housing 98 when the storage chamber 86 is placed in the closed position. The top opening 88 is displaced from the outer surface of the front wall 66 of the dish rack 26 when placed in the open position, (as shown in FIG. 3). The side walls of the storage chamber 86 may include rails (not shown) adapted to fit a groove (not shown) along the inner surface of the dispenser unit housing 98 so as to guide the storage chamber 86 during movement. A biasing member (not shown) may be operatively connected to the storage chamber 86 so as to urge the storage chamber 86 out from the dispenser unit housing 98. A latch assembly (not shown) is configured to retain the storage chamber 86 when the storage chamber 86 is pushed into the dispenser unit housing 98. Thus, the latch assembly and biasing member are configured to produce what is commonly referenced by those skilled in the art as a push-push lock.

The storage chamber 86 includes a first wall 104 spaced apart from a second wall 106, and a third and fourth wall 108, 110 extending between the first and second walls 104, 106 so as to define a generally rectangular shaped compartment. A dispenser unit door 94 may be disposed on the bottom of the storage chamber 86, opposite and spaced apart from the top housing wall 100 of the dispenser unit housing 98. The closing mechanism is configured to urge the dispenser unit door 94 in a closed position relative the bottom of the storage chamber 86.

The bottom portion of the front wall 66 of the dish rack 26 includes a bottom opening 102 dimensioned so as to allow the dispenser unit door 94 to freely pivot to an open position. As illustratively shown in FIG. 10, the bottom opening 102 of the dispenser unit housing 98 is dimensioned to allow the dispenser unit door 94 to pivot freely. The dispenser unit 62 is in fluid communication with the hydraulic circuit 76 when the dish rack 26 is in the first position. For instance, a passage 84 of the hydraulic circuit 76 may open into an inner surface of the front wall 66 disposed above the opening of the storage chamber 86. Accordingly, wash water may be introduced into the storage chamber 86 of the dispenser unit 62.

In operation, the user may open the dispenser unit 62 by pushing on the storage chamber 86, wherein the storage chamber 86 is released from engagement with the latch assembly and the biasing member pushes the storage chamber 86 out of the dispenser unit housing 98 into the open position. The top opening 88 is exposed, and the user may introduce a single dose of detergent into the storage chamber 86. The user closes the dispenser unit 62, wherein the top opening 88 is placed below an opening of a passage 84 of the hydraulic circuit 76. The dish rack 26 is slid to the first position, wherein the dish rack 26 is placed in fluid communication with the spraying system 38. Specifically, the hydraulic circuit intake 78 is fluidly coupled to the tub outtake 80 of the spraying system 38, as illustrated in FIG. 9.

Water from the spraying system 38 is introduced into the hydraulic circuit 76 and to the passage 84 in fluid communication with the dispenser unit 62. Pressure from the introduction of water into the closed storage chamber 86 urges the dispenser unit door 94 outwardly into the bottom opening 102 of the front wall 66 wherein detergent falls from the storage chamber 86 into the tub 12. The closing mechanism is thus free to urge the dispenser unit door 94 into the closed position when the wash water is no longer introduced into the dispenser unit 62.

Figure 5:
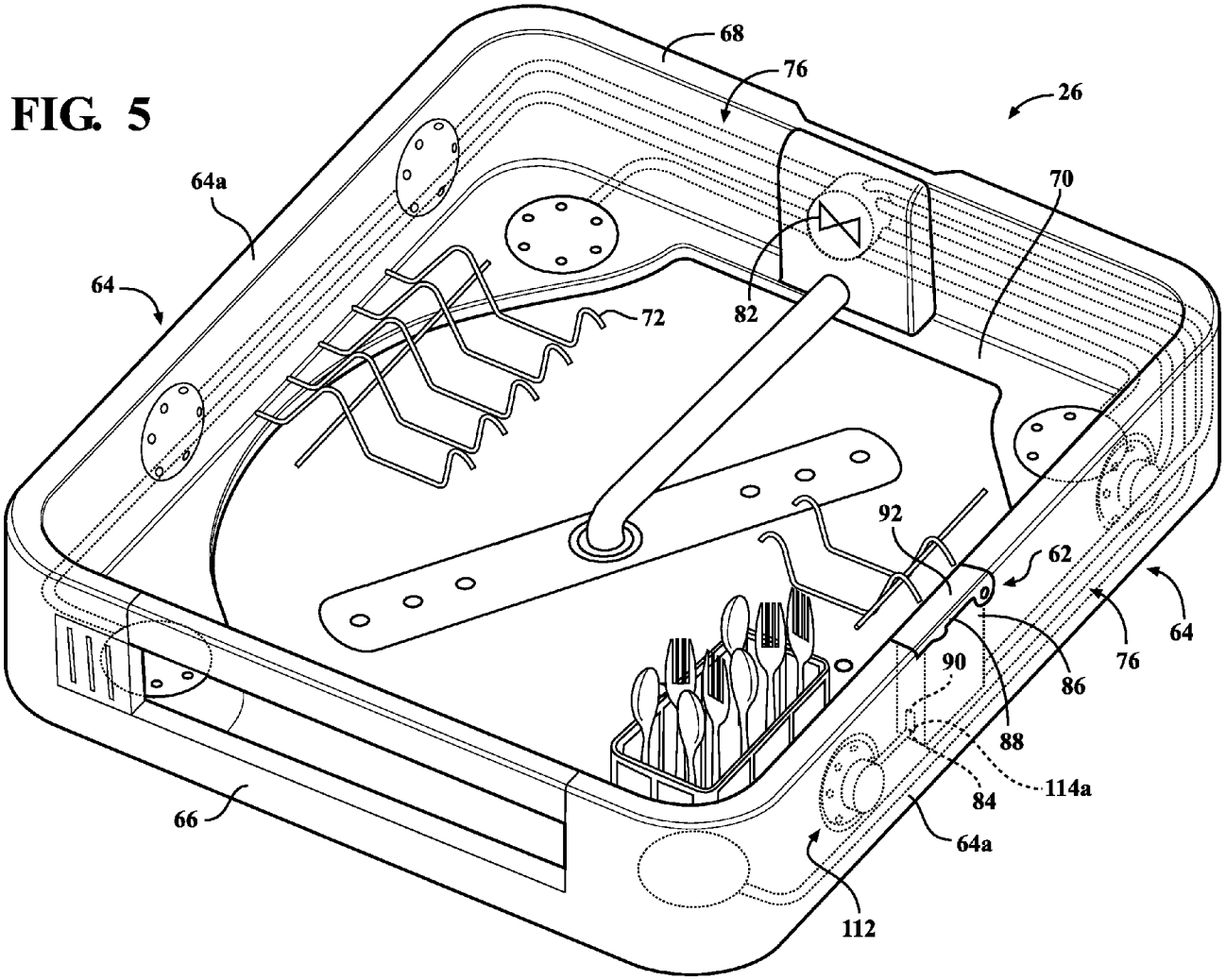
FIG. 5 is a perspective view of a dish rack configured to spray an additive onto a specific wash zone of the dishwasher.
Figure 5A:
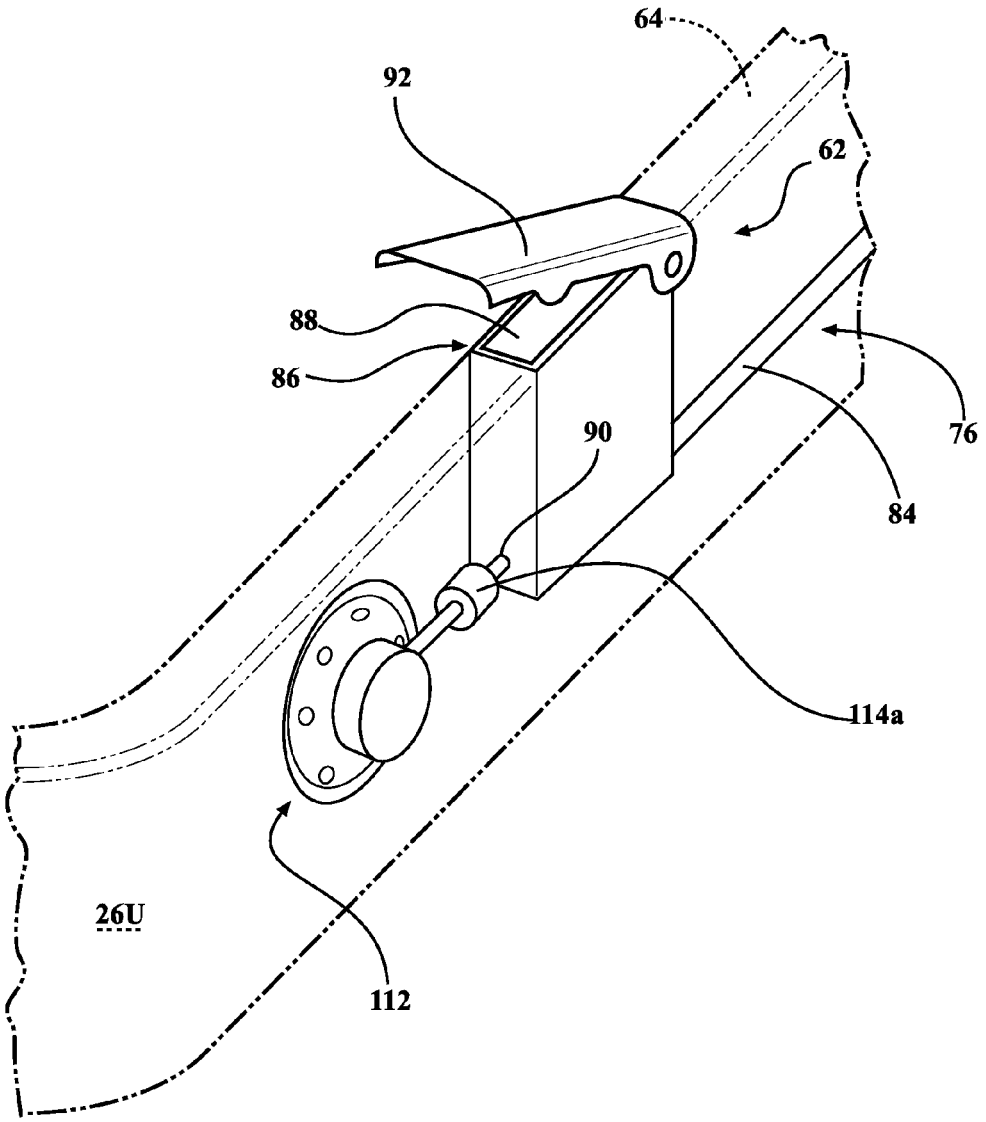
FIG. 5*a* is an isolated view of the dispenser unit shown in FIG. 5.

With reference now to FIGS. 5 and 5*a*, the dispenser unit 62 may be further configured to introduce an additive to a specific wash zone. In an illustrative embodiment, the dispenser unit 62 is disposed on a side wall 64 of an upper dish rack 26. The dispenser unit 62 is disposed upstream from a spray nozzle 112 disposed on the dish rack 26. A passage 84 of the hydraulic circuit 76 extends between the storage chamber 86 and the spray nozzle 112. Thus, wash water is introduced into the storage chamber 86 and ejected through the spray nozzle 112 into a specific wash zone. Such an embodiment may be useful for introducing an additive such as a silverware cleaner, or polisher into a basket containing silverware and disposed in the wash zone of the spray nozzle 112.

The storage chamber 86 includes a top opening 88 and an outlet 90. The top opening 88 may be closed by a cover 92. The outlet 90 is registered to the passage 84 of the hydraulic circuit 76. The passage 84 fluidly connects the storage chamber 86 to the spray nozzle 112. A biasing member (not shown) may be operatively connected to the cover 92 so as to urge the cover 92 into an open position wherein the cover 92 is displaced from the top opening 88 of the storage chamber 86. The dispenser unit 62 may further include a latch assembly (not shown) configured to retain the cover 92 in a closed position. The latch assembly and biasing member may be configured to produce what is commonly referenced by those skilled in the art as a push-push lock. Thus, the cover 92 may be closed by pushing the cover 92 onto the top opening 88, and may be opened by pushing the cover 92 once again onto the top opening 88.

The storage chamber 86 may be dimensioned so as to form a generally rectangular shaped compartment. The outlet 90 is disposed on a portion of the storage chamber 86 facing the spray nozzle 112. A valve 114*a* may be operatively connected to the outlet 90 so as to control the flow of additives from the storage chamber 86 into the spray nozzle 112. The valve 114*a* may be operable to release a mixture of wash water and additive into the spray nozzle 112 upon experiencing a predetermined fluid pressure. Such a function may be useful in instances where it is desirable to mix the additive with wash water prior to treating items.

In operation, the user accesses the storage chamber 86 by opening the cover 92. The top opening 88 is exposed, and the user may introduce a single dose of additive into the storage chamber 86. The user closes the cover 92, and pushes the dish rack 26 into the first position wherein the dish rack 26 is fluidly coupled with the spraying system 38. Thus, the storage chamber 86 and spray nozzle 112 are positioned to receive wash water.

The water from the hydraulic conduit 56 of the spraying system 38 is introduced into the hydraulic circuit 76 and to the dispenser unit 62. Initially, wash water mixes with the additive within the storage chamber 86. The valve 114*a* is configured to release the mixture into the spray nozzle 112 upon experiencing a predetermined fluid pressure. Upon experiencing the predetermined fluid pressure, the valve 114*a* opens fluid communication between the storage chamber 86 and the spray nozzle 112. A mixture of additive and wash water is ejected through the spray nozzle 112 into a specific wash zone. Such a dispenser unit 62 may be beneficial for cleaning a specific type of dishware. For instance, silverware may be placed in a basket positioned in front of the spray nozzle 112 located downstream from and in fluid communication with the dispenser unit 62. An additive for cleaning silverware is poured into the storage chamber 86 and is sprayed directly onto the silverware during washing operations.

Figure 6:
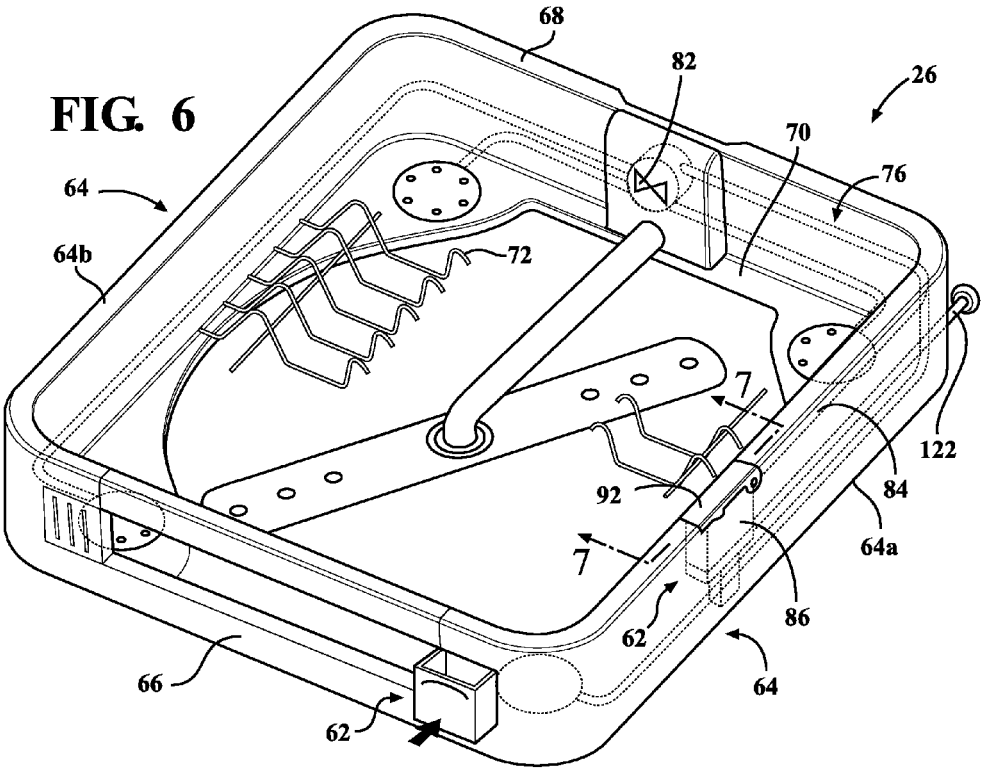
FIG. 6 is a perspective view of a dish rack having a dispenser unit configured to hold a bulk supply of an additive.
Figure 7:
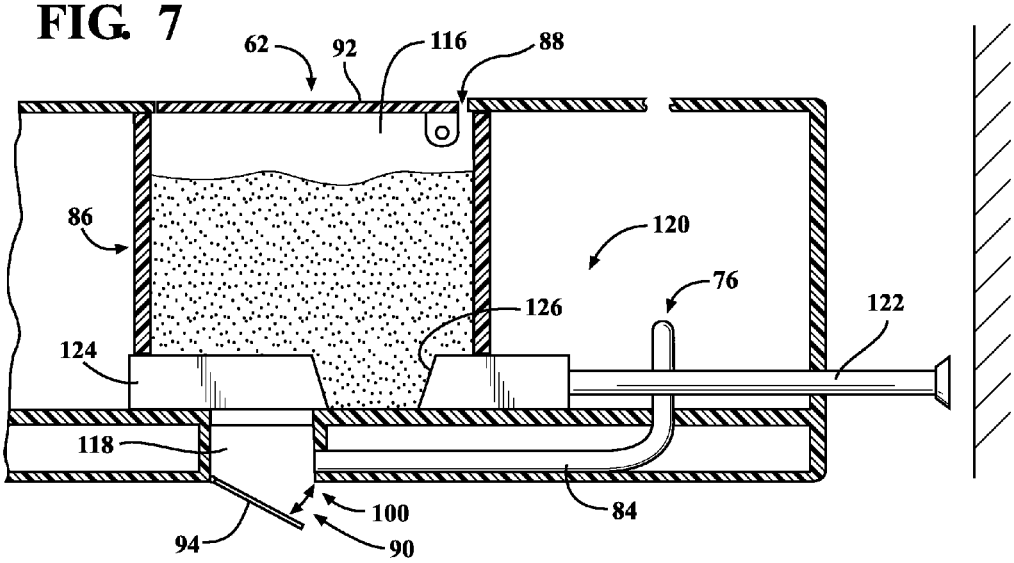
FIG. 7 is a cross-sectional view of FIG. 6 taken along line 7-7, showing a dispenser mechanism configured to eject a discrete amount of additive from the dispenser unit.

With reference now to FIGS. 6 and 7, an illustrative embodiment of a dish rack 26 having a dispenser unit 62 configured to hold a bulk supply of an additive and release a single dose of the additive in a washing cycle is provided. For use herein, bulk supply refers to an amount of an additive sufficient to treat multiple loads of kitchenware. A single dose refers to an amount of an additive sufficient to treat a single load of kitchenware.

The dispenser unit 62 is shown disposed on the upper dish rack 26. The dispenser unit 62 is mounted within a side wall 56 of the upper dish rack 26. The dispenser unit 62 includes a storage chamber 86 having a top opening 88 and an outlet 90. The cover 92 is pivotably attached to the top opening 88.

The storage chamber 86 includes a first space 116 configured to hold a bulk supply of an additive and a second space 118 configured to hold a single dose of the additive. The storage chamber 86 may be formed as one with the dish rack 26 during a molding process. A dispenser unit door 94 is operatively mounted to an outlet 90 disposed on the second space 118. The second space 118 is in fluid communication with the hydraulic circuit 76. Attachment features for mounting the cover 92 and the dispenser unit door 94 to the dispenser unit 62 may also be formed as one with the dish rack 26 during the injection molding process.

The cover 92 is pivotably attached to a top opening 88 of the storage chamber 86 so as to provide access for introducing detergent into the storage chamber 86, and closing the storage chamber 86. The dispenser unit 62 may include a latch assembly (not shown) operable to keep the cover 92 closed relative to the top opening 88. The latch assembly may be configured to release the cover 92 upon a push from the user or may include a button (not shown) operable to release the cover 92 from the open position.

The dispenser unit 62 includes a dispensing mechanism 120 configured to release a single dose of additive into the washing chamber 22. With reference again to FIG. 6, an illustrative view of a mechanical dispensing mechanism 120 adapted for use herein is provided. The dispensing mechanism 120 includes an elongated member 122 projecting outwardly from a back wall 68 of the dish rack 26. The elongated member 122 is rigid and includes a head 124 having a head opening 126 dimensioned to receive a single dose of additive therein. The elongated member 122 is displaceable along the length of the side wall 64 of the dish rack 26 so as to move the head 124 between a first and second position. In the first position, the head 124 is configured receive a single dose of additive within the head opening 126. In the second position, the head opening 126 is configured to introduce the single dose of additive within the washing chamber 22. A biasing member (not shown) may be coupled to the elongated member 122 so as to urge the elongated member 122 into the first position.

As shown in FIG. 7, the head opening 126 is in the first position, wherein the head opening 126 is above and axially offset from the outlet 90 of the storage chamber 86. Accordingly, the contents of the head opening 126 are contained within the head 124. The head opening 126 defines an intermediate chamber configured to hold a single dose of additive. When the dish rack 26 is pushed into the washing chamber 22, the elongated member 122 abuts against the inner back wall 18 of the tub 12, and positions the head 124 above the second space 118. The discrete amount of additive is free to fall into an empty second space 118. Fluid pressure from the introduction of wash water is sufficient to open the dispensing unit door 28 so as to introduce a single dose of additive into the washing chamber 22.

In operation, the user initially introduces a bulk supply of additive into the dispenser unit 62, filling up the first space 116. The dish rack 26 is placed in the first position wherein the hydraulic circuit 76 is operable to receive wash water from the spraying system 38. Additionally, the head 124 is moved to the second position wherein the content within the intermediate chamber fills the second space 118. The wash water exerts a fluid pressure into the second space 118, pushing the dispenser unit door 94 open, wherein a single dose of the additive is introduced into the washing chamber 22. The single dose of additive is mixed with the wash water during washing operations and distributed through the spraying system 38 via the pump and filter assembly 48. Any remaining additive may be introduced into the washing chamber 22 during subsequent washing operations in the manner described above.

The dispensing mechanism 120 may be actuated by fluid pressure from a passage 84 of the hydraulic circuit 76. Any dispensing mechanism 120 currently known and used in the art may be adapted for use herein, illustratively including a mechanical timer which is pressure or flow operated so as to close or open an opening based upon fluid pressure or flow. For instance, the mechanical timer may be operatively mounted to the outlet 90 of the storage chamber 86. The mechanical timer is placed in fluid communication with a passage 84 of the hydraulic circuit 76, and is configured to open and close fluid communication with the outlet 90. Accordingly, the mechanical timer is configured to release a discrete amount of additive from the bulk supply held within the storage chamber 86 during a washing cycle. It should be appreciated by those skilled in the art the dispenser mechanisms described herein is illustrative and not limiting to the scope of the invention.

With reference again to FIGS. 1 and 6, the dishwasher 10 may include an upper and lower dish rack 26U, 26L, each having at least one dispenser unit 62. The dispenser units 62 may be configured to deliver a load of detergent to the washing chamber 22, administer a single dose of an additive such as a rinsing agent to the load, and spray silverware with an additive configured to clean silverware.

In operation, the user positions the dish racks 26U, 26L in the second position, as shown in FIG. 9, and introduces an additive into the dispenser units 62. For instance, the user may pour a bulk supply of a rinse agent into a dispenser unit 62 configured to release a single dose of the rinse agent during a washing operation. The user may further introduce a single dose of detergent into dispenser unit 62 configured to release the detergent during a washing operation, and a single dose of silverware cleaner into a dispenser unit 62 fluidly coupled to a spray nozzle 112 configured to introduce the additive into a basket holding silverware. The dish racks 10 are then placed in the first position wherein the hydraulic circuit intake 78 of respective upper and lower dish racks 10 is docked with a respective hydraulic conduit 56 of the spraying system 38. Thus, the dispensers are placed in fluid communication with the spraying system 38. The dishwasher 10 may further include a sensor indicated by reference letter "S" operable to detect when the hydraulic circuit intake 78 is fully docked with a respective tub outtake 80. The sensor "S" provides a signal to a controller referenced by the letter "C" in the dishwasher 10 which allows for actuation of the washing cycle when the upper and lower dish rack 26U, 26L are properly docked with respective upper and lower tub outtakes 88.

The user may simply select a wash program. Water is introduced into the washing chamber 22 via the main intake (not shown), and distributed through the spraying system 38. The diverter 54 may direct water to the lower dish rack 26 wherein the main valve 114 opens the passage 84 connected to the dispenser unit 62 configured to release detergent. Thus, wash water is mixed with the detergent and pumped into the spraying system 38 via the pump and filter assembly 48 to be distributed throughout the washing chamber 22.

Subsequently, the diverter 54 may be configured to direct wash water to the upper dish rack 26L, wherein the valve 114 is configured to open the passage 84 connected to dispenser unit 62 fluidly coupled to a spray nozzle 112. The spray nozzle 112 is configured to spray a washing additive into the wash zone in front of the spray nozzle 112. For instance, the user may load the dispenser unit 62 with a silverware cleaning additive. Water from the hydraulic circuit 56 is introduced into the dispenser unit. The water fills the storage chamber 86 of the dispenser unit 62, wherein the water and additive are pushed into the outlet 90, and released into the spray nozzle 112, and sprayed onto the basket of silverware disposed in front of the spray nozzle 112. In a final rinsing cycle of the wash program, the diverter 54 may direct water back to the lower dish rack 26. The valve 114 is configured to open a passage 84 to the dispenser unit 62 configured to release a single dose of rinsing additive from a bulk supply. Fluid pressure is exerted on the dispensing mechanism 120 so as to release a single dose of the rinsing agent into the washing chamber 22.

Figure 12:
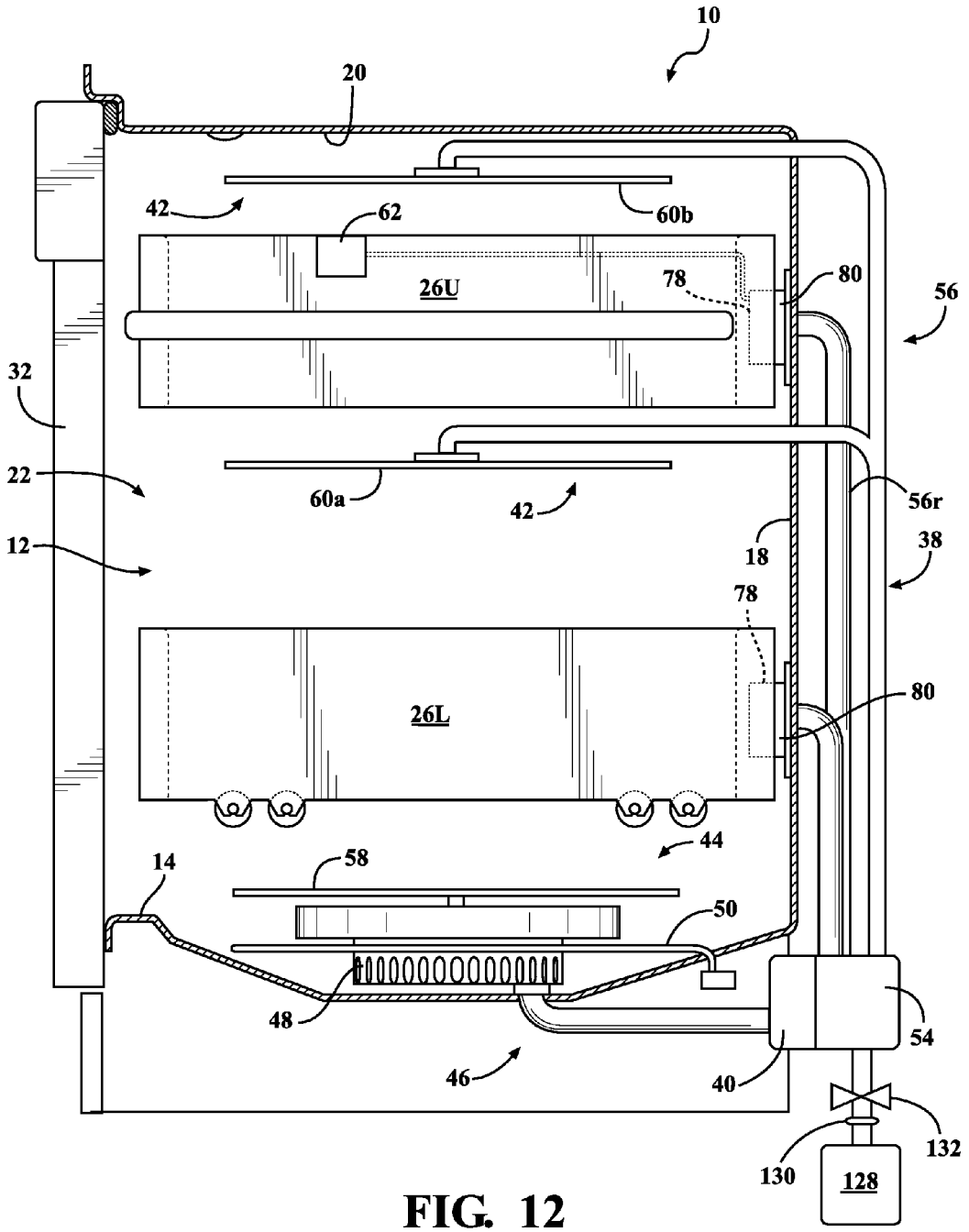
FIG. 12 is a schematic view a dish rack fluidly coupled to a public utility water source.

With reference now to FIG. 12, a dish rack fluidly coupled to a public utility water source 128, ("PUWS") is provided. The dishwasher includes a dedicated passage **56*r* of the hydraulic conduit 56 directly coupled to the PUWS 128. The passage 56*r* may extend out of the tub 12 of the dishwasher 10 and includes an end portion adapted to engage a spout 130 providing water from the PUWS 128. In such an embodiment, fluid pressure for delivering water into the respective dispenser units 62 are provided by the PUWS 128. It should be appreciated by those skilled in the art that the PUWS 128 may provide water pressure from anywhere between 20 to 100 psi, as opposed to typical pump and filter assemblies which provide approximately 2 psi of water pressure. Accordingly, greater water pressure is provided relative to water pressure generated by typical pump and filter assemblies. The passage 34*r* may fluidly couple the PUWS 128 to the diverter 54. The controller C of the dishwasher 10 may actuate the diverter 54 so as to open fluid communication between the PUWS 128 and a respective dispenser unit 62. A regulating valve 132 may be fluidly coupled to passage 56*r* so as to provided a desired water pressure to the dispenser units 62. Water flows from the PUWS 128, through the diverter 54 into a respective tub outtake 80. The water continues into the hydraulic circuit intake 78, through a passage 84 of the hydraulic circuit 76 of the dish rack 26 and into the dispenser unit 62 wherein the additive contained therein is flushed into the tub 12**.

Figure 13:
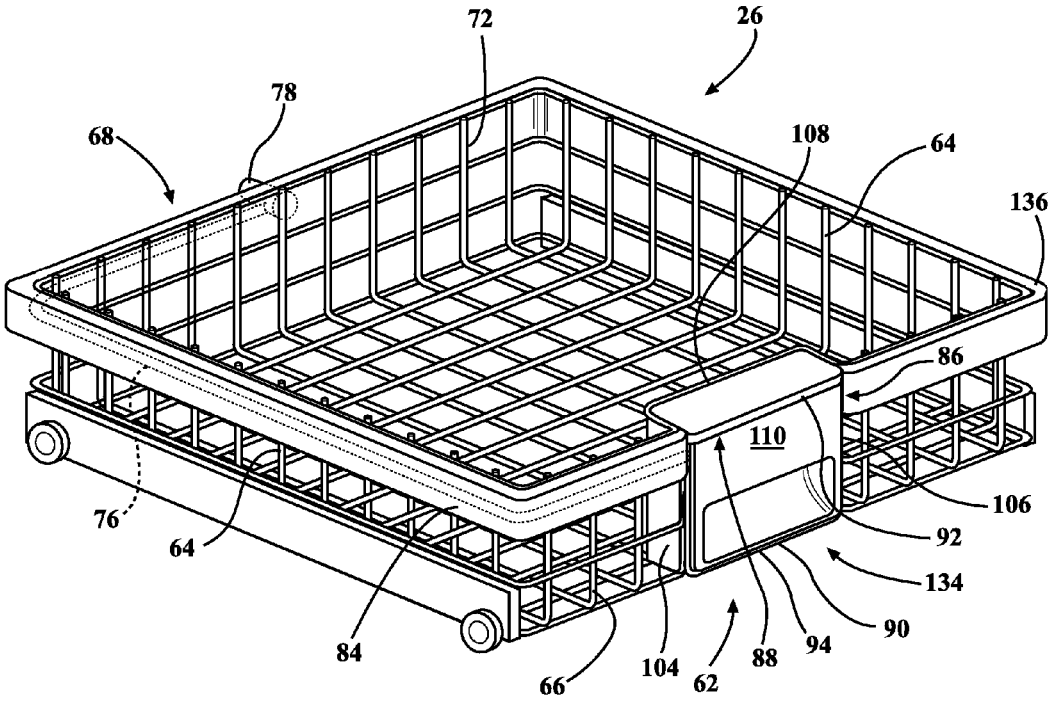
FIG. 13 is a perspective view of the dish rack having a dispenser unit and a handle formed on a front face of the dispenser unit.
Figure 14:
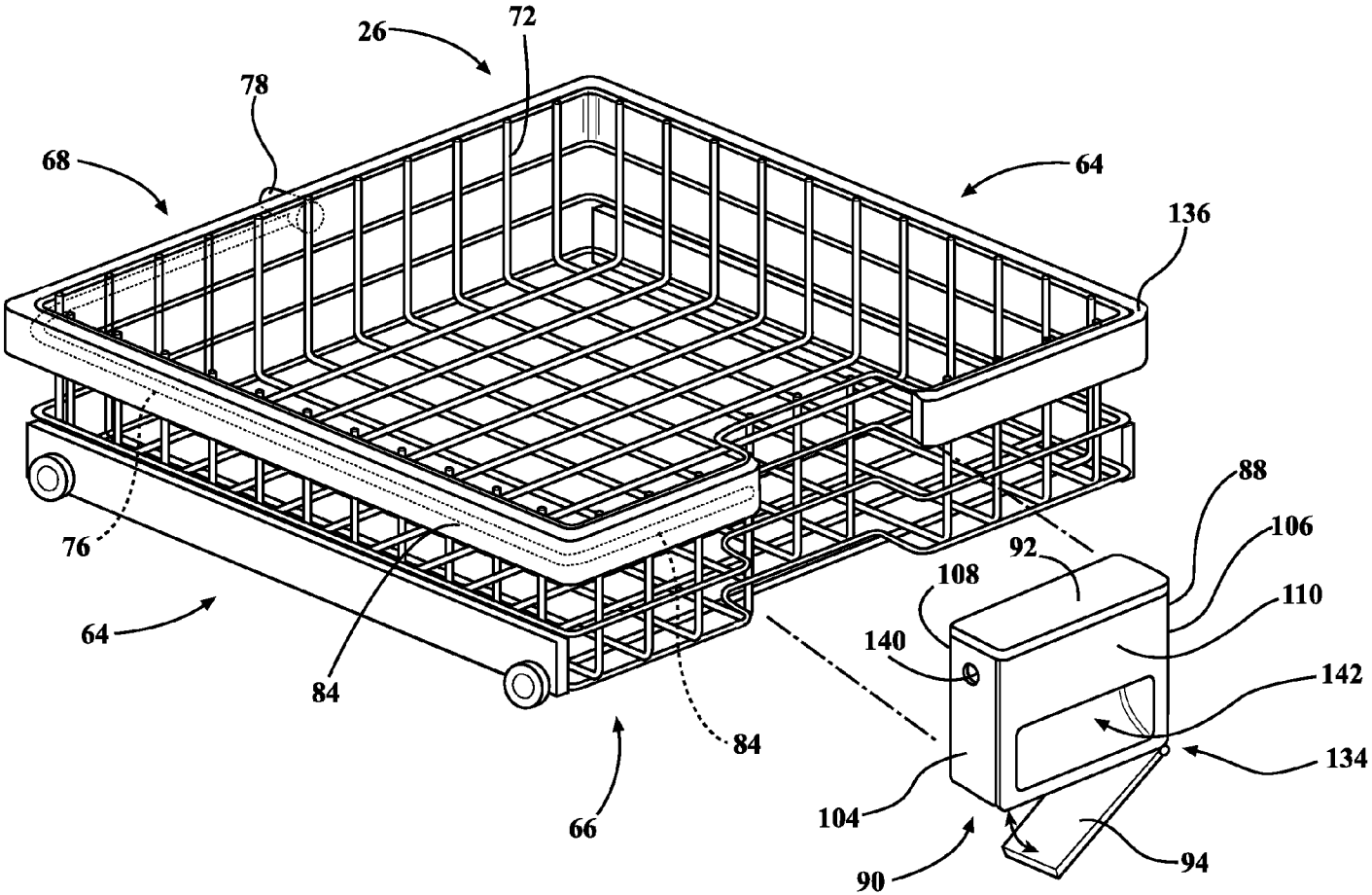
FIG. 14 is an exploded view of the dish rack of FIG. 13, showing an inlet for which water may be introduced into the storage chamber.
Figure 15:
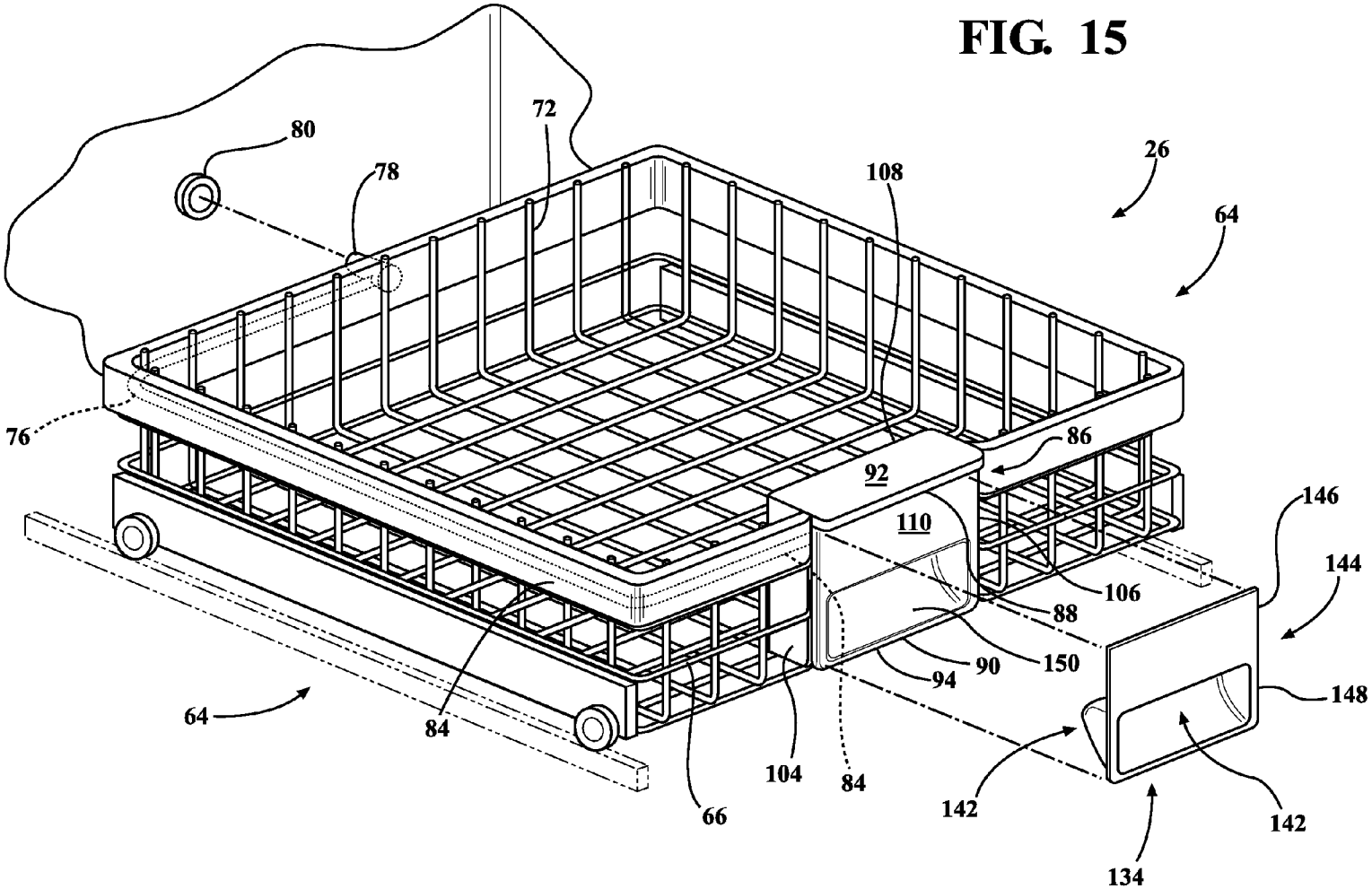
FIG. 15 is an exploded view of the dispenser unit of FIG. 13, showing the faceplate and the handle.

With reference now to FIGS. 13, 14 and 15, a dish rack 26 having a dispenser unit 62 having a handle 134 is provided. The dispenser unit 62 is mounted to the front wall 66 of the dish rack 26. The dish rack 26 includes a band 136 bounding an upper peripheral edge of the dish rack 26. The hydraulic circuit 76 is disposed within the band 136. One end of the hydraulic circuit is fluidly connected to the hydraulic circuit intake 78. The hydraulic circuit intake 78 is disposed on the back wall 68 of the dish rack 26. The side, front and back walls 64, 66, 68 of the dish rack 26 are formed of a plurality of wires intersecting each other so as to form a generally lattice structure. The bottom edges of each side wall 64 include an elongated panel supporting a plurality of rollers configured to assist the dish rack from moving in and out of the tub (not shown).

The dispenser unit 62 may be integrally formed with the band 136 or may be formed as a separate piece. The dispenser unit 62 includes a storage chamber 86 having a top opening 88 and an outlet 90. A cover 92 may be operatively attached to the top opening 88 and is opposite from a dispenser unit door 94 which is operatively attached to the outlet 90. The storage chamber 86 is configured to hold the additive. The storage chamber 86 may include a first wall 104 spaced apart from a second wall 106, a third wall 108 spaced apart from a fourth wall 110, each of the third and fourth wall 108, 110 extends between the first and second walls 104, 106 so as to define a generally rectangular shaped compartment. However, it should be appreciated that the storage chamber may be shaped otherwise based upon aesthetic or manufacturing and production desires. The storage chamber 86 includes an inlet 140 configured to be placed in fluid communication with a passage 84 of the hydraulic circuit 76.

The outlet 90 is configured to allow the additive to escape into the washing chamber 22. The dispenser unit door 94 is operatively mounted to the outlet 90. A closing mechanism (not shown) may be mounted to the dispenser unit door 94. The closing mechanism is configured to move the dispenser unit door 94 between an open position and a closed position, the concept is generally shown in FIG. 10. In the open position, the dispenser door 28 is displaced from the outlet 90 so as to allow the contents of the storage chamber 86 to fall into the washing chamber 22. In the closed position the dispenser unit door 94 is engaged with the outlet 90 so as to retain the additive within the storage chamber 86. Water from the hydraulic circuit 76 is operable to fill the storage chamber 86, building pressure therein so as to push the additive out the outlet 90 and into the tub (not shown).

The handle 134 is formed on the front face of the dispenser unit 62. The handle 134 is adapted to be engaged by the grip of a user. The handle 134 is illustratively shown as an arcuate concave surface extending upwardly into a recess 142 of the dispenser unit 62. Thus, the concave surface is recessed with respect to an outer surface of the fourth wall 110 which is disposed at the front of the dispenser unit 62. Thus, a user may insert his/her fingers upwardly into the recess 142 and simply pull the dish rack 26 out from the tub. Further, the fourth wall 110 of the dispenser unit faces the front of the dish rack 26, and includes a planar surface providing a space for the user to push the dish rack 26 back into the tub 12.

With reference now to FIG. 15, the dispenser unit 62 may further include a face plate 144. The face plate 144 includes a planar support portion 146, and a handle portion 148. The planar support portion 146 has a back surface adapted to mount onto a respective surface of the fourth wall 110 of the dispenser unit 62. The face plate 144 may be mounted to the dispenser unit 62 using any currently known attachment means, such as adhesive, vibrational welding, or the like. The exposed surface of the planar support portion 146 may include indicia (not shown) indicating a brand, a trademark, model number or the like.

Alternatively, the dispenser unit 62 may be include a female receiving portion (not shown) and the face plate 144 may include a corresponding tab (not shown) adapted to removably engage the female receiving portion so as to be able to attach and detach. The dispenser unit 62 includes a space 150 beneath the storage chamber 86. The space 150 is configured to receive the handle portion 148 of the face plate 144. Such an embodiment may be desirable to facilitate production as the dish racks 62 may be customized to accommodate the brand of dishwasher 10.

Obviously, many modifications and variations of the present invention are possible in light of the above teachings and may be practiced otherwise than as specifically described while within the scope of the appended claims.

What is claimed is:

1. A dish rack for use in a dishwasher in fluid communication with a water source, the dishwasher having a tub for holding the dish rack, the dish rack comprising:

a front wall, a back wall, and a pair of side walls bounding a space for holding items to be washed, at least a portion of the back wall and at least a portion of one of the side walls comprise an inner sidewall surface, an outer sidewall surface, and a channel between the inner sidewall surface and the outer sidewall surface;

a hydraulic circuit comprising a tubular passage disposed within the channel and in fluid communication with the water source, the hydraulic circuit having a hydraulic circuit intake disposed on an outer surface of the back wall; and a dispenser unit having at least a portion of the dispenser unit disposed within the channel, the dispenser unit configured to hold an additive, the dispenser unit in fluid communication with the hydraulic circuit, wherein fluid pressure from the hydraulic circuit ejects the additive from the dispenser unit into the dishwasher.

2. The dish rack as set forth in claim 1, wherein the dispenser unit further includes a storage chamber having a chamber wall bounding a storage space configured to hold an additive, the storage chamber having a top opening and an outlet, the top opening configured to receive the additive, wherein fluid pressure ejects the additive through the outlet into the tub.

3. The dish rack as set forth in claim 2, wherein the dispenser unit further includes a cover mounted to the top opening, the cover movable between an open position and a closed position, in the open position the top opening is exposed, in the closed position the top opening is closed.

4. The dish rack as set forth in claim 3, further including a dispenser unit door operatively mounted to the outlet, and a closing mechanism configured to open and close the dispenser unit door relative to the outlet so as to selectively retain the additive within the storage chamber.

5. The dish rack as set forth in claim 4, wherein the closing mechanism is configured to urge the dispenser unit door into the closed position, and wherein fluid pressure from the hydraulic circuit is sufficient to move the dispenser unit door into the open position wherein the additive within the storage chamber is ejected into the tub.

6. The dish rack as set forth in claim 2, further including a dispenser unit housing integrally formed to the dish rack, the dispenser unit housing having a top wall and a first opening, the first opening configured to receive the storage chamber, the storage chamber movable with respect to the dispenser unit housing between an open position and a closed position, wherein in the open position the top opening of the storage chamber is exposed, and in the closed position the top opening of the storage chamber is covered by the top wall of the dispenser unit housing.

7. The dish rack as set forth in claim 6, wherein the top wall includes a second opening in fluid communication with the hydraulic circuit.

8. The dish rack as set forth in claim 1, further including a spray nozzle mounted to one of the side walls of the dish rack, the spray nozzle downstream from the dispenser unit, the spray nozzle fluidly coupled to the dispenser unit, wherein fluid from the hydraulic circuit is operable to eject the additive in the dispenser unit through the spray nozzle.

9. The dish rack as set forth in claim 8, wherein the hydraulic circuit includes at least one passage and the dispenser unit further includes a storage chamber having a wall bounding a space configured to hold an additive, the storage chamber having a top opening and an outlet in fluid communication with the at least one passage, the top opening configured to receive the additive, wherein fluid pressure ejects the additive through the outlet into the spray nozzle.

10. The dish rack as set forth in claim 1, further including a dispensing mechanism actuated by fluid pressure, the dispensing mechanism configured to release a discrete amount of additive from the dispenser unit upon experiencing fluid pressure.

11. The dish rack as set forth in claim 10, wherein the dispenser unit further includes a storage chamber having a first space and a second space, the first space larger than the second space, the dispensing mechanism configured to fill the second space with content from the first space.

12. The dish rack as set forth in claim 11, wherein the second space is fluidly coupled to the hydraulic circuit, the second space including an outlet, fluid pressure from the hydraulic circuit configured to eject contents of the second space through the outlet, and into the tub.

13. The dish rack as set forth in claim 12, wherein the dispensing mechanism is a mechanical timer mounted to the outlet, the mechanical timer configured to open and close the outlet upon experiencing fluid pressure from the hydraulic circuit.

14. The dish rack as set forth in claim 1, further comprising a valve disposed within the channel and operably connected to the hydraulic circuit upstream of the dispenser unit and downstream of the hydraulic circuit intake to open and close fluid communication to the dispenser unit.

15. The dish rack as set forth in claim 1, wherein at least one of the dish rack side walls having an upper peripheral edge, the at least one of the dish rack side walls further includes a band disposed along the upper peripheral edge of the side wall, and the hydraulic circuit is disposed within the band.

16. The dish rack as set forth in claim 15, wherein a portion of at least one of the dish rack side walls is formed by a plurality of wires, each of the plurality of wires intersecting each other so as to form a generally lattice structure.

17. The dish rack as set forth in claim 1, further including a handle, the handle mounted on the dispenser unit.

18. The dish rack as set forth in claim 17, wherein the dispenser unit is disposed on the front wall of the dish rack.

19. The dish rack as set forth in claim 17, wherein the dispenser unit includes a dispenser front wall, and wherein the handle is an arcuate concave surface extending upwardly so as to define a recess with respect to an outer surface of the front wall of the dispenser unit.

20. The dish rack as set forth in claim 17, wherein the dispenser unit includes a dispenser front wall and a face plate detachably mounted on to the front wall of the dispenser unit, and wherein the handle is disposed on the face plate.

21. The dish rack as set forth in claim 20, wherein the dispenser unit includes a storage chamber having a chamber wall bounding a chamber space configured to hold an additive, the storage chamber having a top opening and a chamber outlet, the top opening configured to receive the additive, wherein the face plate includes a planar support portion and a handle portion, the planar support portion is mounted to a surface of the dispenser unit, and the handle portion is disposed beneath the storage chamber.

22. A dish rack for use in a dishwasher, the dishwasher having a hydraulic conduit in fluid communication with a water source, the dish rack comprising:

a front wall, a back wall, and a pair of side walls bounding a space for holding items to be washed, at least a portion of the back wall and at least a portion of one of the side walls comprise an inner sidewall surface, an outer sidewall surface, and a channel between the inner sidewall surface and the outer sidewall surface;

a hydraulic circuit comprising at least one tubular passage disposed within the channel and a hydraulic circuit intake disposed on an outer surface of the back wall;

the hydraulic conduit having a plurality of passages, wherein one of the plurality of passages is directly coupled to the water source, and wherein the hydraulic circuit intake is coupled to the one of the plurality of passages directly coupled to the water source; and a dispenser unit having at least a portion of the dispenser unit disposed within the dish rack channel, the dispenser unit configured to hold an additive, the dispenser unit in fluid communication with the hydraulic circuit, wherein fluid pressure from the water source passes through the hydraulic circuit so as to eject the additive from the dispenser unit into the dishwasher.

* * * * *